US012797926B2

(12) United States Patent
Horii et al.

(10) Patent No.: US 12,797,926 B2
(45) Date of Patent: Nov. 17, 2026

(54) WORK ROLL BALANCE FORCE SETTING METHOD AND ROLLING MILL RUNNING METHOD, ROLLING MILL RUNNING SWITCHING METHOD, AND ROLLING MILL

(71) Applicant: Primetals Technologies Austria GmbH, Linz (AT)

(72) Inventors: Kenji Horii, Hiroshima (JP); Tatsunori Sugimoto, Hiroshima (JP); Shunsuke Murato, Hiroshima (JP); Manfred Hackl, Lichtenberg (AT); Alois Seilinger, Linz (AT); Lukas Pichler, Linz (AT)

(73) Assignee: Primetals Technologies Austria GmbH, Linz (AT)

( * ) Notice: Subject to any disclaimer, the term of this patent is extended or adjusted under 35 U.S.C. 154(b) by 316 days.

(21) Appl. No.: 18/704,819

(22) PCT Filed: Nov. 1, 2021

(86) PCT No.: PCT/JP2021/040290
§ 371 (c)(1),
(2) Date: Apr. 25, 2024

(87) PCT Pub. No.: WO2023/073998
PCT Pub. Date: May 4, 2023

(65) Prior Publication Data
US 2024/0416402 A1 Dec. 19, 2024

(51) Int. Cl.
*B21B 13/14* (2006.01)
*B21B 31/20* (2006.01)
(Continued)

(52) U.S. Cl.
CPC ..... *B21B 13/14* (2013.01); *B21B 31/203* (2013.01); *B21B 37/58* (2013.01); *B21B 2013/028* (2013.01)

(58) Field of Classification Search
CPC ..... B21B 37/16; B21B 37/18; B21B 37/20; B21B 37/28; B21B 13/02; B21B 13/14
See application file for complete search history.

(56) References Cited

U.S. PATENT DOCUMENTS 6,240,756 B1 * 6/2001 Tsugeno ..... B21B 37/16 72/11.8
6,401,506 B1 * 6/2002 Ogawa ..... B21B 37/68 72/247
(Continued)

FOREIGN PATENT DOCUMENTS

JP S59127912 A 7/1984
JP S59185508 A 10/1984
(Continued)

OTHER PUBLICATIONS

Translation of JPS59185508 (Year: 2026).*
(Continued)

*Primary Examiner* — Matthew Katcoff
(74) *Attorney, Agent, or Firm* — Liang & Hennessey LLP; Brian Hennessey

(57) ABSTRACT

Work roll balance force setting method of rolling mill. Determine kiss roll load Pk, rolling load Pr, and rolling torque Tr of work rolls relative to work roll angle θx of tip position of rolled material between start and completion of biting of rolled material using mill longitudinal rigidity coefficient K and rolling condition. Determine traction coefficient μrt between work and intermediate rolls, and maximum value μrtmax of μrt in relation to θx when hypothetical work roll balance force Pb is applied from sum P of Pk, Pr, and Pb, and Tr between start and completion of biting.
(Continued)

Compare tolerated value μrtcr of μrt with μrtmax. Work roll balance force at start of biting reset to equal to or larger than required when μrt assumes maximum value μrtmax, and equal to or smaller than limit based on strength of rolling mill, when μrtcr is equal to or larger than μrtmax.

9 Claims, 32 Drawing Sheets

(51) Int. Cl.
*B21B 37/58* (2006.01)
*B21B 13/02* (2006.01)

(56) References Cited

U.S. PATENT DOCUMENTS 6,895,794 B2 * 5/2005 Yamamoto ..... B21B 31/16 72/247
7,310,982 B2 * 12/2007 Ogawa ..... B21B 37/28 72/10.4
7,812,558 B2 * 10/2010 Mori ..... B21B 37/46 318/432
11,400,499 B2 * 8/2022 Ishii ..... B21B 37/46
2022/0023473 A1 * 1/2022 Lu ..... A61L 9/015

FOREIGN PATENT DOCUMENTS

JP S6117305 A 1/1986
JP 3067589 B2 7/2000

OTHER PUBLICATIONS

International Search Report and Written Opinion received in International Application No. PCT/JP2021/040290 dated Jul. 7, 2022, 9 pages.
Konno et al., "Analysis of Unsteady Load Mechanism in Strip Rolling Processes and Its Control in Commercial Line," Kawasaki Steel Giho, vol. 33, No. 1, 2001, pp. 1-16.

* cited by examiner

Fig 3

| DRIVE | ROLL | | SUM OF HORIZONTAL FORCE, Fbt, Fit, Fwt | | | |
|---|---|---|---|---|---|---|
| | | | (a) MILL IDLE RUNNING | (b) WHEN Tr1 IS APPLIED | (c) WHEN Tr2 IS APPLIED | (d) NORMAL ROLLING |
| INTERMEDIATE ROLL | DEFINITION | | Fobi=0, Foiw=0.7Fr<br>Fbi=Fbb=0<br>Fiw=Fww=0 | Fobi=0, Foiw=Fr<br>Fbi=Fr<br>Fiw=Fr | Fobi=0, Foiw=Fr<br>Fbi=(TAF-1)Fr<br>Fiw=Fr | Fobi=0, Foiw=Fr<br>Fbi=0<br>Fiw=Fr |
| | BACK UP ROLL | Fbt | -Fobi+Fbi=0 | -Fobi-Fbi=-Fr | -Fobi+Fbi=(TAF-1)Fr | -Fobi+Fbi=0 |
| | INTERMEDIATE ROLL | Fit | -Foiw+Fobi+Fiw-Fbi=-0.7Fr | -Foiw+Fobi+Fiw+Fbi=Fr | -Foiw+Fobi+Fiw-Fbi=-(TAF-1)Fr | -Foiw+Fobi+Fiw-Fbi=0 |
| | WORK ROLL | Fwt | Foiw-Fiw=0.7Fr | Foiw-Fiw=0 | Foiw-Fiw=0 | Foiw-Fiw=0 |

Fig 4

| DRIVE | ROLL | | SUM OF HORIZONTAL FORCE, Fbt, Fit, Fwt | | | |
|---|---|---|---|---|---|---|
| | | | (a) MILL IDLE RUNNING | (b) WHEN Tr1 IS APPLIED | (c) WHEN Tr2 IS APPLIED | (d) NORMAL ROLLING |
| WORK ROLL | BACKUP ROLL | Fbt | 0 | -Fr | 2Fr | 0 |
| | INTERMEDIATE ROLL | Fit | 0 | 2Fr | -4Fr | 0 |
| | WORK ROLL | Fwt | 0 | -Fr | 2Fr | 0 |
| INTER MEDIA TE ROLL | BACKUP ROLL | Fbt | 0 | -Fr | 2Fr | 0 |
| | INTERMEDIATE ROLL | Fit | -0.7Fr | Fr | -2Fr | 0 |
| | WORK ROLL | Fwt | 0.7Fr | 0 | 0 | 0 |
| BACKU P ROLL | BACKUP ROLL | Fbt | 0.7Fr | 0 | 0 | 0 |
| | INTERMEDIATE ROLL | Fit | -1.4Fr | 0 | 0 | 0 |
| | WORK ROLL | Fwt | 0.7Fr | 0 | 0 | 0 |

WORK ROLL BALANCE FORCE SETTING METHOD AND ROLLING MILL RUNNING METHOD, ROLLING MILL RUNNING SWITCHING METHOD, AND ROLLING MILL

CROSS-REFERENCE TO RELATED APPLICATIONS

The present application is a national phase application of PCT Application No. PCT/JP2021/040290, filed Nov. 1, 2021, entitled "WORK ROLL BALANCE FORCE SETTING METHOD AND ROLLING MILL RUNNING METHOD, ROLLING MILL RUNNING SWITCHING METHOD, AND ROLLING MILL", which is incorporated by reference in its entirety.

BACKGROUND OF THE INVENTION

1. Field of the Invention

The present invention relates to a work roll balance force setting method and a rolling mill running method, a rolling mill running switching method, and a rolling mill.

2. Description of the Related Art

As an example of a hot rolling facility that prevents biting failure of strip materials by small-diameter work rolls, Japanese Patent No. 3067589 describes a technology like the one below. An entry-side strip passing guide and an exit-side strip passing guide that guide a hot-rolled strip material to work rolls are arranged on the entry side and exit side of a rolling mill. Since the advancing hot-rolled strip material warps upward due to reaction force, by holding down the strip material by using hold-down rolls that can be lifted and lowered so as to prevent the strip material from floating, the strip material gets to have pressing force which is larger than the reaction force received from the work rolls, and the work rolls surely bite the hot-rolled strip material. In addition, in order to transfer necessary torque to the work rolls, roll balance force or roll bending force of the work rolls is controlled when the rolled material is bitten, and inter-roll contact force between the work rolls and intermediate rolls is increased.

A strip can be rolled to have a thinner strip thickness effectively by using work rolls with a smaller radius, but this accompanies a decline in the load capacity of a drive spindle of the work rolls. In view of this, intermediate roll driving or backup roll driving that uses a drive spindle of intermediate rolls or backup rolls with higher load capacity is adopted in some cases.

Here, in a case of intermediate roll driving or backup roll driving, since rolling torque is transferred to work rolls at inter-roll contact portions, if a significant slide occurs between rolls, it becomes not possible to transfer necessary rolling torque.

For example, Japanese Patent No. 3067589 discloses that biting failure is prevented by increasing roll balance force or bending force as much as possible only to the extent allowed by the strength of roll necks at the time of biting.

However, there is room for improvement in the technology described above because it does not take into consideration the fact that roll balance force becomes excessive in a case where kiss roll occurs when rolling is performed to attain a thin strip thickness.

The present invention provides a work roll balance force setting method and a rolling mill running method, a rolling mill running switching method, and a rolling mill that enable suppression of an inter-roll slide without damaging components such as bearings even if kiss roll occurs at the time of biting.

SUMMARY OF THE INVENTION

The present invention includes a plurality of means for solving the problems described above, and an example thereof is a work roll balance force setting method of a rolling mill that includes a pair of upper and lower work rolls, and one or more pairs of upper and lower rolls that are provided on sides of the work rolls that are opposite to a rolled material, the rolling mill driving the work rolls by supplying rolling torque Tr from the rolls to the work rolls, the work roll balance force setting method including the steps of: obtaining a mill longitudinal rigidity coefficient K of the rolling mill; determining a kiss roll load Pk of the work rolls in relation to a work roll angle θx of a tip position of the rolled material between a start of biting of the rolled material and completion of the biting, the kiss roll load Pk being determined by using the obtained mill longitudinal rigidity coefficient K and a rolling condition; determining a rolling load Pr and the rolling torque Tr in relation to the work roll angle θx of the tip position of the rolled material between a start of biting of the rolled material and completion of the biting; determining a traction coefficient μrt between the work rolls and the rolls, and a maximum value μrtmax of the traction coefficient in relation to the work roll angle θx of the tip position in a state in which hypothetical work roll balance force Pb is applied, the traction coefficient μrt between the work rolls and the rolls, and the maximum value μrtmax of the traction coefficient being determined from a sum P of the kiss roll load Pk, the rolling load Pr, and the hypothetical work roll balance force Pb, and the rolling torque Tr between a start of biting of the rolled material and completion of the biting; obtaining a tolerated value μrtcr of the traction coefficient μrt of the rolling mill; comparing the maximum value μrtmax determined at the step of determining the traction coefficient μrt with the tolerated value μrtcr; and resetting work roll balance force at a start of biting of the rolled material to a value which is equal to or larger than the work roll balance force that is required when the traction coefficient μrt assumes the maximum value μrtmax, and equal to or smaller than the work roll balance force that is a limit based on a constraint in terms of strength of the rolling mill, when the tolerated value μrtcr is equal to or larger than the maximum value μrtmax.

According to the present invention, it is possible to suppress an inter-roll slide without damaging components such as bearings even if kiss roll occurs at the time of biting. Problems, configurations, and advantages other than those described above are made clear by the following explanation of an embodiment.

BRIEF DESCRIPTION OF THE DRAWINGS

FIG. 3 is a figure depicting examples of horizontal force applied onto rolls at the time of biting in a case of intermediate roll driving.

FIG. 4 is a figure depicting an example of comparison among the sums of horizontal force applied onto rolls at the time of biting when different rolls are driven, and the torque amplification factor is 3.

DETAILED DESCRIPTION

Figure 1:
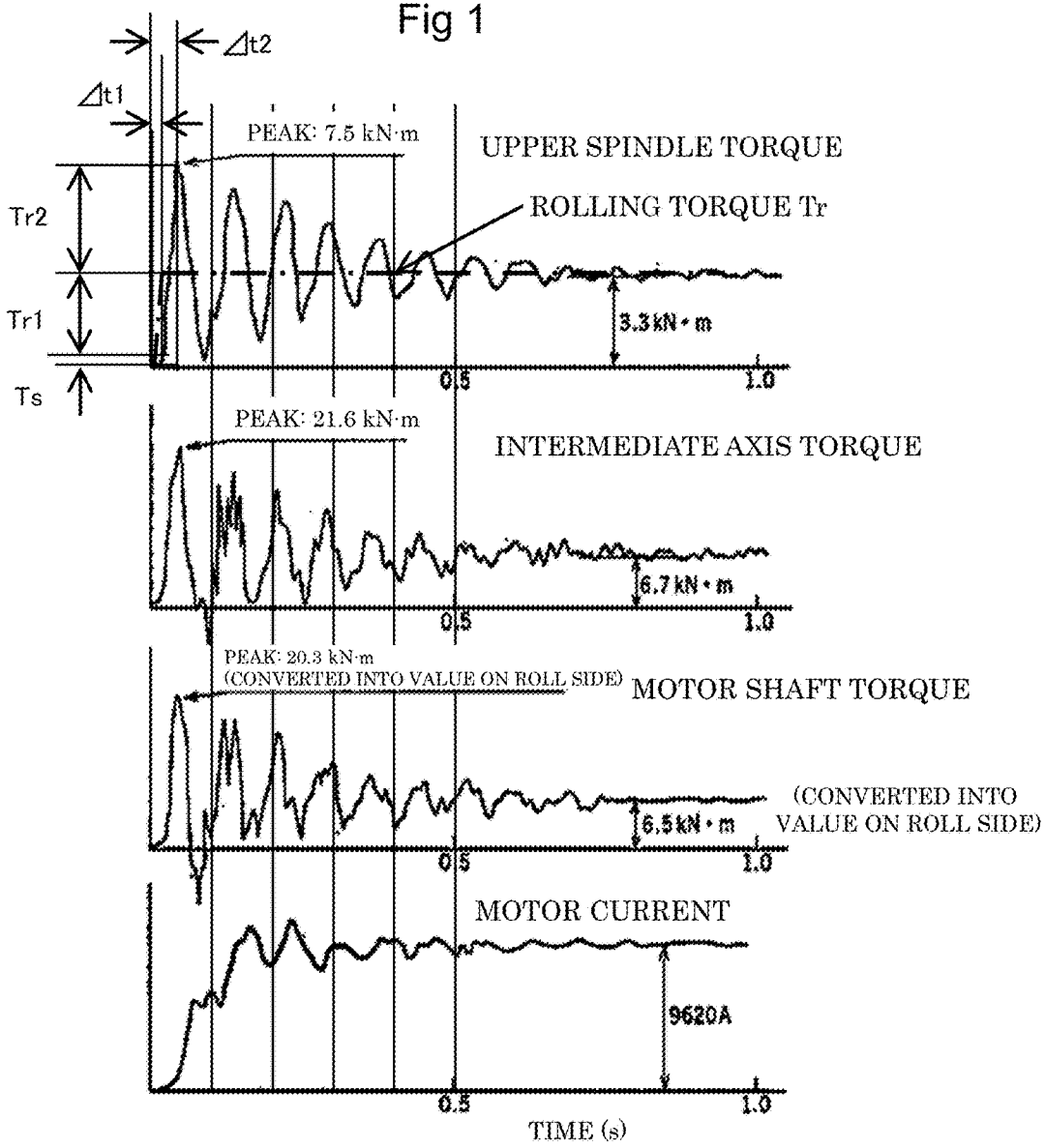
FIG. 1 is a figure depicting an example of changes in spindle torque at the time of tip biting.

An embodiment of a work roll balance force setting method, and a rolling mill running method, a rolling mill running switching method, and a rolling mill according to the present invention is explained by using FIG. 1 to FIG. 32.

Hereinafter, identical or corresponding constituent elements in the figures used in the present specification are given identical or similar reference characters, and repetitive explanations about these constituent elements are omitted in some cases.

First, the background that has led to the configurations of the work roll balance force setting method and the rolling mill running method, the rolling mill running switching method, and the rolling mill in the present invention is explained by using FIG. 1 to FIG. 15.

FIG. 1 is a figure depicting an example of actual measurement results of changes in spindle torque at the time of tip biting of a finishing rolling mill having an intermediate axis. As depicted in FIG. 1, spindle torque varies at a cycle of the natural frequency of torsion. From FIG. 1, it is estimated that rise time $\Delta t1$ of rolling torque Tr is approximately 0.01 [sec].

At the moment when $\Delta t1$ has elapsed, and the rolling torque Tr has risen, applied spindle torque is only Ts yet, and thus an amount of torque Tr1 required in addition to the rolling torque Tr is supplied by a change in the inertial force of a roll. Mainly, an inertial change that accompanies slight deceleration of a backup roll supplies the amount of torque Tr1 required in addition to the rolling torque Tr.

Thereafter, at the moment when $\Delta t2$ has elapsed, the largest spindle torque is applied. At this time, torque which is Tr2 larger than the rolling torque Tr is applied onto the spindle. Tr2 and a change in the inertial force of the roll balance out, and mainly Tr2 and an inertial change that accompanies slight acceleration of the backup roll balance out.

Figure 2:
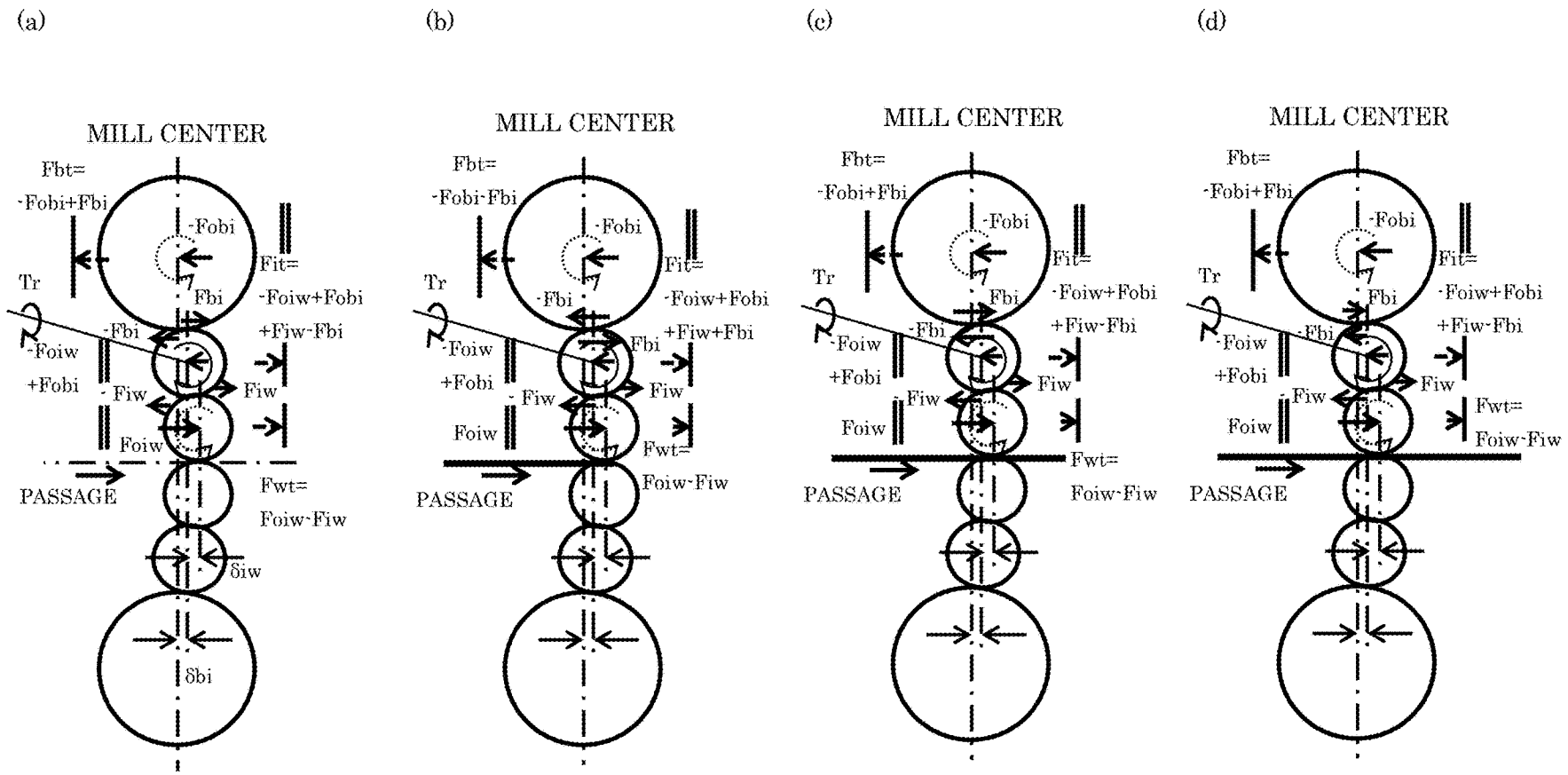
FIG. 2 is a figure depicting examples of horizontal force applied onto rolls at the time of biting in a case of intermediate roll driving.

FIG. 2 is a figure depicting examples of horizontal force that is applied onto rolls at the time of biting in a case of intermediate roll driving. (a) depicts a situation before a rolled material is bitten, (b) depicts a situation where Tr1 is applied, (c) depicts a situation where Tr2 is applied, and (d) depicts a situation of normal rolling when there are no longer spindle torque variations in the initial period of biting. FIG. 3 is a figure depicting the sum of horizontal force applied onto rolls at the time of biting in a case of intermediate roll driving. Here, force that is applied in the rolling direction is defined as positive force, and force in the direction opposite to the rolling direction is defined as negative force.

In FIG. 2, δiw represents an offset amount between an intermediate roll and a work roll, δbi represents an offset amount between a backup roll and the intermediate roll, Fobi represents an offset component of a rolling load Pr that is applied between the backup roll and the intermediate roll, Foiw represents an offset component of the rolling load Pr that is applied between the intermediate roll and the work roll, Fbi represents tangential force that is applied between the backup roll and the intermediate roll, Fiw represents tangential force that is applied between the intermediate roll and the work roll, Fbt represents the sum of horizontal force applied onto the backup roll, Fit represents the sum of horizontal force applied onto the intermediate roll, and Fwt represents the sum of horizontal force applied onto the work roll. In addition, Fr represents (rolling torque)/(work roll radius), Fbb represents the resistance of backup roll bearing sections, Fii represents the resistance of intermediate roll bearing sections, Fww represents the resistance of work roll bearing sections, and Fbb, Fii, and Fww are treated as being almost equal to 0 because they are small values as compared to Fr.

In addition, it is assumed in FIG. 3 that the offset component Foiw at the time of normal rolling is made equal to the driving tangential force Fiw, a kiss roll load applied at the time of mill idle running is (rolling load Pr)×0.7, tangential force generated by an inertial change in the backup roll becomes almost dominant at the timing of Tr1 when Tr1 is applied, and overtorque (TAF-1) Tr generated to a drive spindle at the timing of Tr2 when Tr2 is applied and mainly an inertial increase in the backup roll balance out. Note that "TAF" means a torque amplification factor, and is the rate between the maximum axial torque and steady rolling torque. In FIG. 1, TAF is determined as 7.5 kNm/3.3 kNm=2.27.

As depicted in (a) in FIG. 2, (b) in FIG. 2, and FIG. 3, an inertial change in the backup roll at the time of biting of a rolled material adds to rolling torque until the spindle torque rises. Thereafter, as depicted in (c) in FIG. 2, the overtorque of the drive spindle of the work roll and the inertial change in the backup roll balance out. Furthermore, as depicted in (d) in FIG. 2, when there are no longer spindle torque variations in the initial period of biting, because the frictional resistance of the backup roll is treated as being 0 here, the tangential force Fbi that is applied between the backup roll and the intermediate roll becomes 0. The tangential force Fiw that is applied between the intermediate roll and the work roll becomes Fr.

FIG. 4 is a figure depicting an example of comparison among the sums of horizontal force applied onto rolls at the time of biting when the torque amplification factor is 3. FIG. 4 depicts the sums of horizontal force applied onto rolls when spindle torque varies from mill idle running to the initial period of biting, and Tr1 or Tr2 is applied under a condition that offset components of the rolling load Pr are adjusted such that when there are no longer spindle torque variations in the initial period of biting (equivalent to (d) normal rolling), the sums of horizontal force applied onto rolls (the sums of the offset components of the rolling load Pr and inter-roll tangential force) become almost 0.

As depicted in FIG. 4, there is a problem that when the torque amplification factor is 3, the sum Fit of horizontal force applied onto the intermediate roll when Tr2 is applied in a case of work roll driving becomes −4Fr, and force to support the intermediate roll in the rolling direction increases inevitably.

In addition, in a case of backup roll driving, if a kiss roll load is applied, the sum Fit of horizontal force applied onto the intermediate roll during mill idle running before biting becomes −1.4Fr, which is a little large value. Note that at the timings of Tr1 and Tr2, the sum Fbt of horizontal force applied onto the backup roll, the sum Fit of horizontal force applied onto the intermediate roll, and the sum Fwt of horizontal force applied onto the work roll become small.

In contrast to this, in a case of intermediate roll driving, the sum Fit of horizontal force applied onto the intermediate roll when Tr2 is applied includes horizontal force of −2Fr which is half the horizontal force applied in a case of work roll driving. In addition, the sum Fwt of horizontal force applied onto the work roll both when Tr1 is applied and when Tr2 is applied is small as compared to that in a case of work roll driving.

Here, features of the torque amplification factor are explained. The torque amplification factor is expressed as (Tr2+Tr)/Tr. The larger the rolling torque Tr is, the smaller the torque amplification factor tends to be. In addition, the maximum value of peak torque tends to be generated at the time of rated torque, and is (torque amplification factor)×(rated torque). In this case, the torque amplification factor at the time of the rated torque is approximately 2.0. Furthermore, when the rolling torque Tr is smaller than the rated torque, the torque amplification factor becomes a large value. For example, when the rolling torque Tr is 50% of the rated torque, the torque amplification factor is approximately a value of 2.0 to 4.0. Here, the rated torque means rolling torque that is generated when output power of a drive motor is 100%.

According to "KAWASAKI STEEL TECHNICAL REPORT Vol. 33 (2001) No. 1, P. 37-42, Analysis of Unsteady Load Mechanism in Strip Rolling Processes and Its Control in Commercial Line," when a roll receives horizontal force F at its roll body section, and a bearing housing of the roll collides with a housing, resultant force Pt that is applied to the colliding section in the rolling direction is expressed by Pt=(horizontal force F)+(impact force P) $(=(2KhF\delta)^{0.5})$. Here, Kh is an elasticity coefficient of deformation of the housing in the rolling direction, and δ is a distance over which the roll bearing housing moves during the application of the horizontal force F, and is equivalent to the distance between the roll bearing housing and the housing. It has been reported that when F=80 tons, P=220 to 280 tons, and Pt=300 to 360=(3.8 to 4.5)×F, and when F=20 tons, P=90 to 100 tons, and thus Pt=110 to 120=(5.5 to 6.0)×F.

When the roll moves in the rolling direction, and the bearing housing collides with the housing, Pt inevitably becomes a large value which is 3.8 to 6.0 times larger than F, although this depends on the gap between the housing and the bearing housing.

An anti-backlash cylinder can remove the gap between the housing and the bearing housing, and thus can reduce P, and this provides an advantage of making Pt close to F.

Note that since there are a radial gap in a bearing itself and a slight gap between the roll axis and the internal diameter in the bearing inside the bearing, slight impact force is applied even in a case where the bearing housing does not move.

Figure 5:
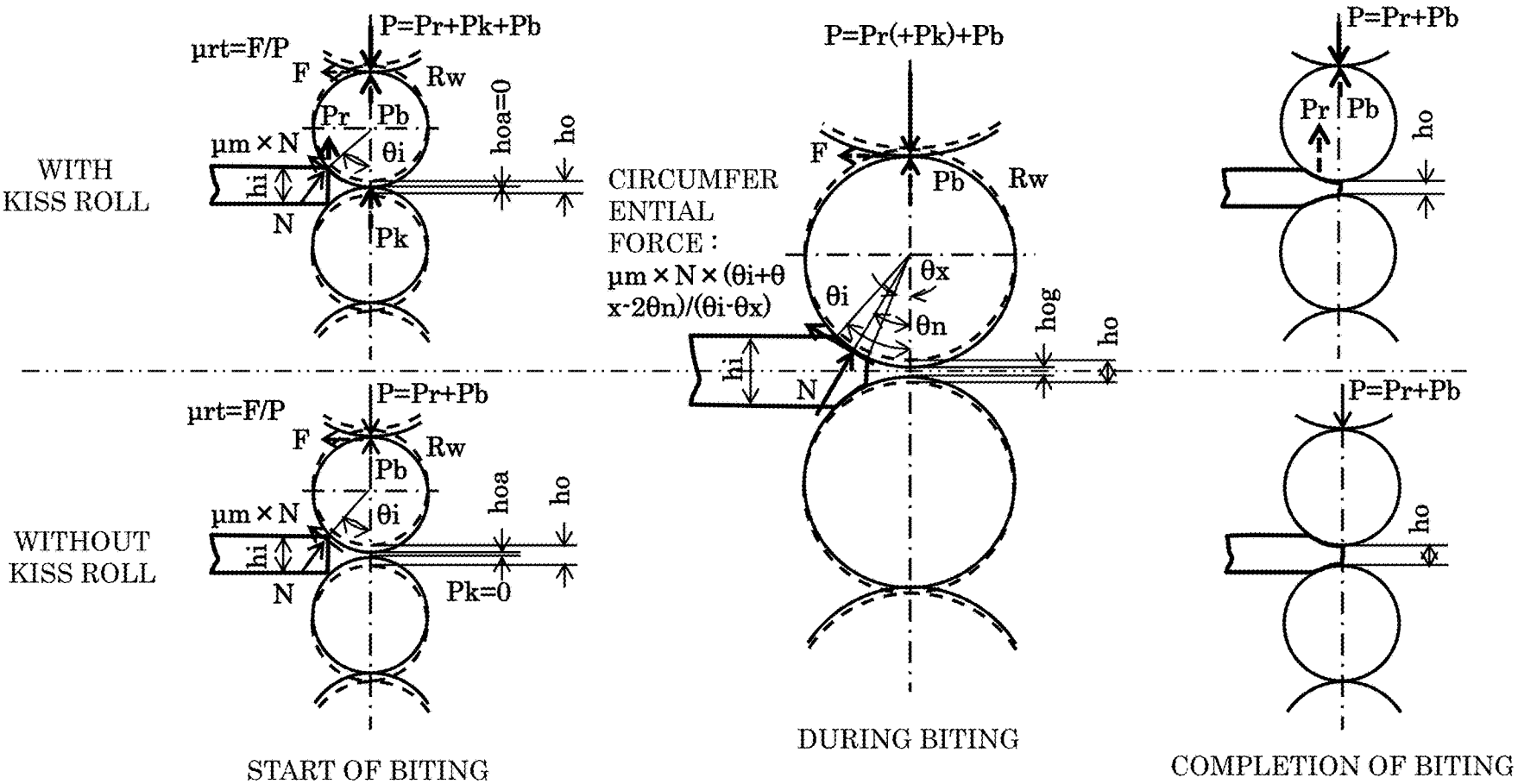
FIG. 5 is a figure depicting a changing process of the gap between work rolls in a biting process.

Next, the traction coefficient μrt between an intermediate roll and a work roll in a case of intermediate roll driving is explained. FIG. 5 depicts changes in the gap between upper and lower work rolls, and force applied onto each section in a biting process when there is kiss roll and when there is not kiss roll.

As depicted in FIG. 5, vertical pressing force P between the intermediate roll and the work roll when there is kiss roll is (rolling load Pr)+(kiss roll load Pk)+(work roll balance force Pb), and the vertical pressing force P between the intermediate roll and the work roll when there is not kiss roll is Pr+Pb.

Here, the traction coefficient μrt means a required coefficient of friction between the work roll and the intermediate roll, and a small required coefficient of friction means making a significant slide unlikely to occur. Since the traction coefficient μrt is represented as F/P, if P is large, the traction coefficient μrt becomes small. When there is kiss roll, P becomes large by an amount corresponding to the kiss roll load Pk as compared to when there is not kiss roll, and thus the traction coefficient μrt becomes small.

In FIG. 5, the angle θi is the biting angle, the angle θx is the angle of the tip position of a rolled material, the angle θn is the angle of a neutral point, and the exit-side strip thickness hoa is the gap between the upper and lower work rolls at the time of biting, and is 0 when there is kiss roll. If hi is the entry-side strip thickness, ho is the exit-side strip thickness, and μm is the coefficient of friction between the work roll and the strip in the process of biting, the advancing speed of the rolled material and the circumferential speed of the rolls are equal to each other at the position of the angle θn. In addition, within the range of the angle θi to θn, the advancing speed of the strip is slower than the roll circumferential speed, and within the range of the angle θn to θx, the advancing speed of the strip is faster than the roll circumferential speed.

Figure 6:
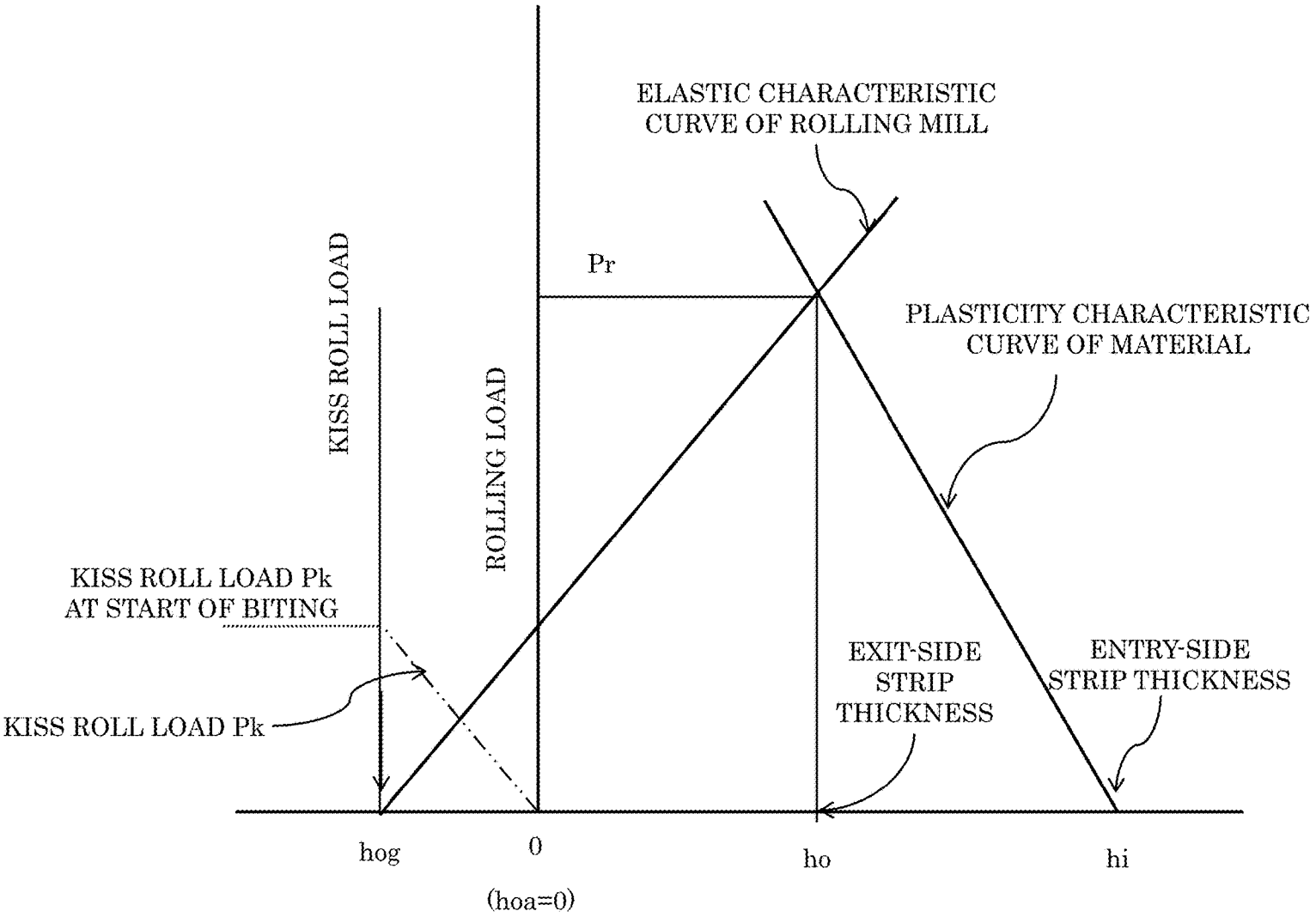
FIG. 6 is a figure depicting a definition of kiss roll.
Figure 7:
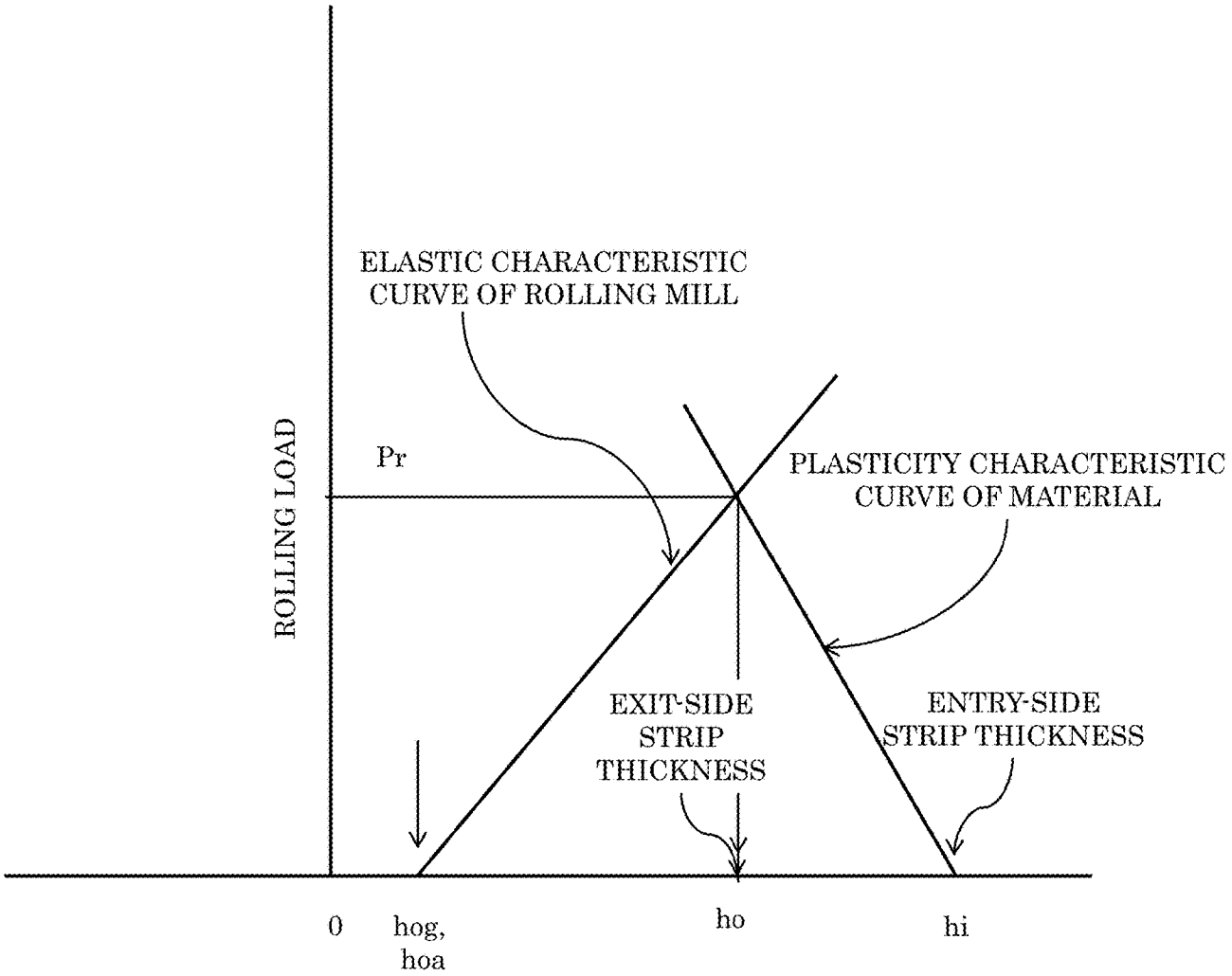
FIG. 7 is a figure depicting the definition of kiss roll.

FIG. 6 depicts changes in the gap between work rolls, and force applied onto each section in a biting process when there is kiss roll, and FIG. 7 depicts changes in the gap between work rolls, and force applied onto each section in a biting process when there is not kiss roll.

Typically, the roll gap is narrowed in advance by an amount corresponding to elastic deformation caused by the rolling load Pr relative to a desired strip thickness before a strip passes therethrough. Then, by biting the strip, the roll load is generated, the roll gap is enlarged and the desired strip thickness can be attained.

Pr is the rolling load, K is the spring constant of the rolling mill, and hereinafter is a mill longitudinal rigidity coefficient K, and R is the work roll radius.

Pr/K is equivalent to an amount to be narrowed, and is the amount corresponding to elastic deformation caused by the rolling load Pr. Here, when the maximum rolling reduction becomes negative inevitably, this means that the upper and lower work rolls have come into contact before the strip passes therethrough, and this state is expressed as kiss roll. The load that is applied between the upper and lower work rolls at the time of kiss roll is defined as a kiss roll load.

If the strip thickness is h, the roll gap before rolling is hog, and M is the coefficient of plasticity, the elastic characteristic curve, when approximately represented by a straight line, can be represented as Pr=K((exit-side strip thickness ho)−hog), and the plasticity characteristic curve of a material, when approximately represented by a straight line, can be represented as Pr=M(ho−(entry-side strip thickness hi)).

Here, the roll gap hog before rolling represents a value obtained by subtracting an elastic deformation amount of the rolling mill that is observed when the strip is pressed further and the kiss roll load Pk is applied, from an amount in a state where the upper and lower work rolls just started contacting, the kiss roll load Pk is 0 yet, and an elastic deformation is not generated. Note that although the upper and lower work rolls are elastically deformed, and their axial centers have come close to each other, the gap between the upper and lower work rolls remains 0 (the gap hoa between the upper and lower work rolls at the time of biting is 0), and is not a negative value.

As depicted in FIG. 5 and FIG. 6, when there is kiss roll, the vertical pressing force P between the intermediate roll and the work roll at the start of biting is Pr+Pk+Pb. With the start of biting, Pr increases, Pk decreases, and when a gap is generated between the upper and lower work rolls, Pk becomes 0. When θx=0, this means completion of the biting, and the strip thickness at the strip tip becomes an exit-side strip thickness ho.

In contrast to this, as depicted in FIG. 5 and FIG. 7, when there is not kiss roll, P=Pr+Pb at the start of biting, during the biting and at completion of the biting, and Pr becomes the largest at the completion of the biting.

Figure 8:
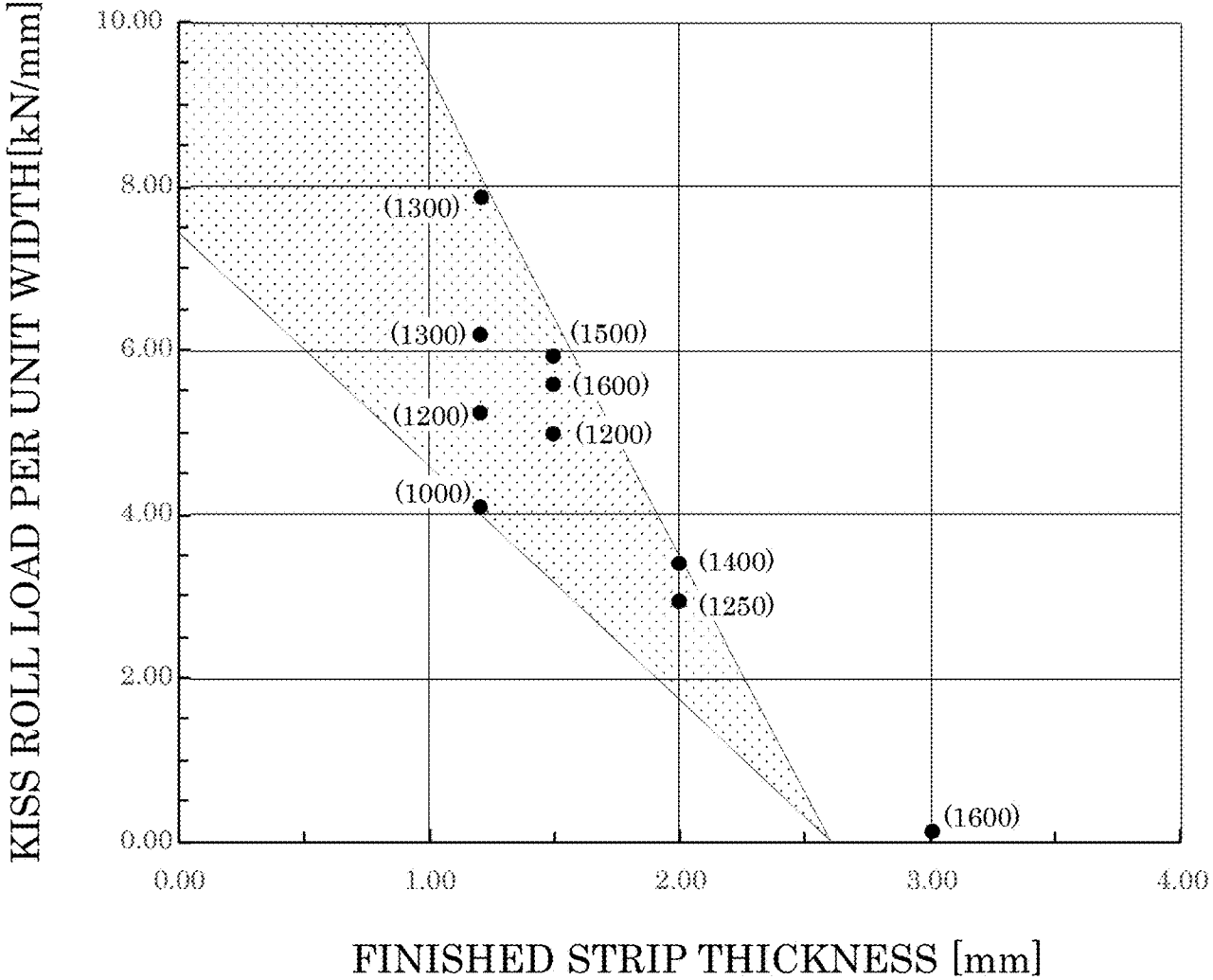
FIG. 8 is a figure depicting the relation with a kiss roll load that is set before rolling is started.
Figure 9:
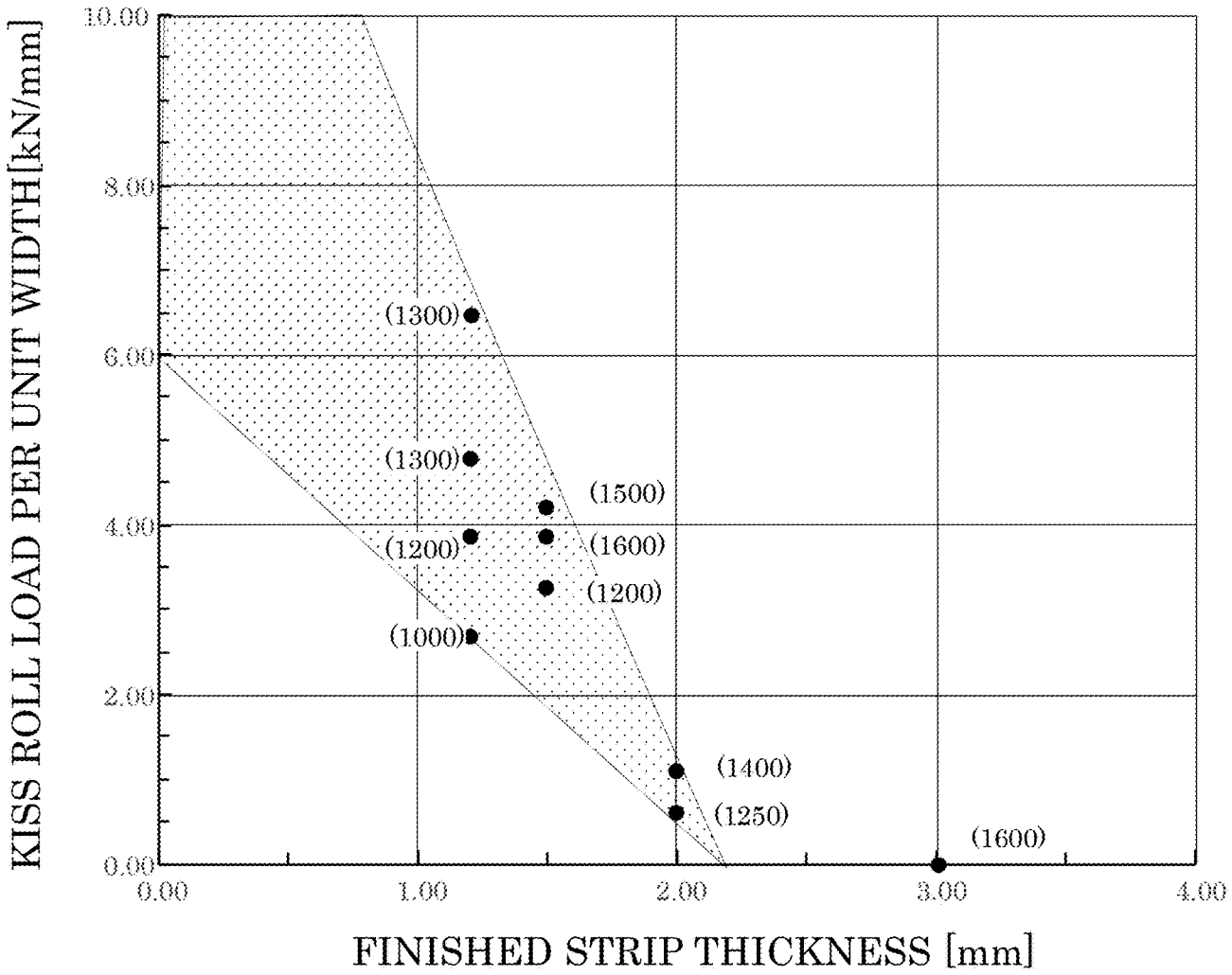
FIG. 9 is a figure depicting the relation with a kiss roll load that is set before rolling is started.

FIG. 8 and FIG. 9 depict the relations between a kiss roll load per unit width and a finished strip thickness of the last stand of a finishing rolling mill set before rolling is started. FIG. 8 depicts a case of the mill longitudinal rigidity coefficient K being 4000 [kN/mm], and FIG. 9 depicts a case of the mill longitudinal rigidity coefficient K being 6000 [kN/mm]. Numbers in FIG. 8 and FIG. 9 represent the strip width [mm], and FIG. 8 and FIG. 9 depict kiss roll load per unit widths that are determined under several hypothetical rolling conditions about the finishing rolling mill.

As depicted in FIG. 8 and FIG. 9, the kiss roll load per unit widths are distributed in certain ranges because they change depending on hypothetical rolling conditions such as an entry-side strip thickness, an exit-side strip thickness or the width and hardness of a rolled material.

In addition, as depicted in FIG. 8, when the mill longitudinal rigidity coefficient K is relatively small, the kiss roll load per unit width becomes a large value as compared to a case where the mill longitudinal rigidity coefficient K is large as depicted in FIG. 9. In addition, whereas Pk starts being generated when the finished exit-side strip thickness ho is approximately 2.6 [mm] in a case where the mill longitudinal rigidity coefficient K is 4000 [kN/mm], Pk starts being generated when the exit-side strip thickness ho is approximately 2.2 [mm] in a case where the mill longitudinal rigidity coefficient K is 6000 [kN/mm] as depicted in FIG. 9. Accordingly, the smaller the mill longitudinal rigidity coefficient K is, the thicker the exit-side strip thickness ho at which the kiss roll load Pk starts being generated tends to be.

In this manner, as the mill longitudinal rigidity coefficient K changes, the state of kiss roll before the start of rolling in certain rolling changes. That is, the traction coefficient μrt (a required coefficient of inter-roll friction) changes depending on the work roll balance force Pb and the state of kiss roll before the start of rolling that changes depending on the value of the mill longitudinal rigidity coefficient K.

Figure 10:
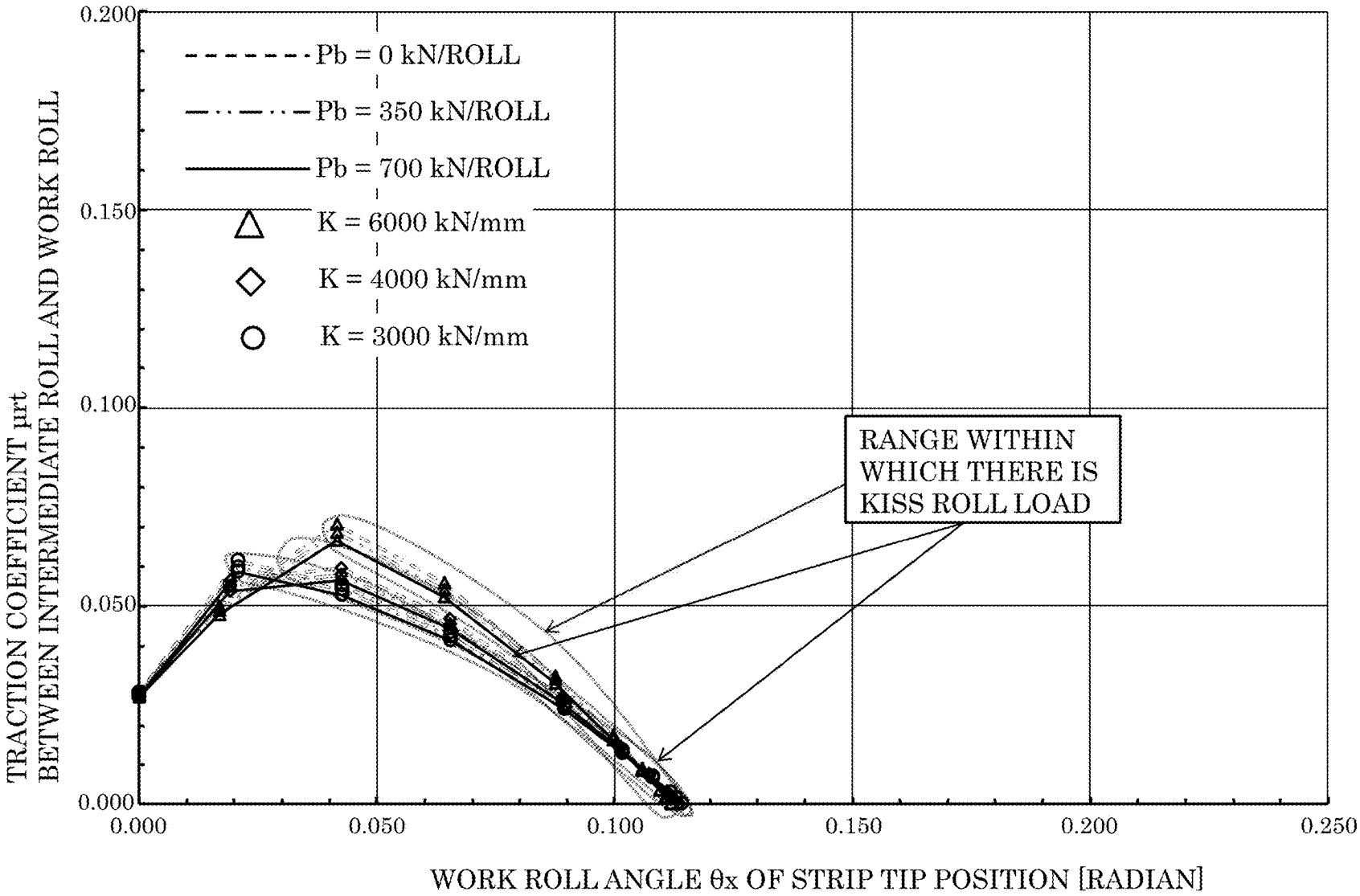
FIG. 10 is a figure depicting the relation between the strip tip position in a roll bite and the traction coefficient between an intermediate roll and a work roll.

FIG. 10 is a figure depicting the relation between the work roll angle θx of the tip position of a rolled material in a roll bite and the traction coefficient μrt between an intermediate roll and a work roll. FIG. 10 depicts results of a simulation in a state in which there is not a lubricant on the rolls, and the rolls are wet with a coolant under a condition where the exit-side strip thickness and width are 1.2 [mm] and 1300 [mm], respectively. In FIG. 10, Δ represents results that are obtained when the mill longitudinal rigidity coefficient K is 6000 [kN/mm], ◇ represents results that are obtained when the mill longitudinal rigidity coefficient K is 4000 [kN/mm], and ○ represents results that are obtained when the mill longitudinal rigidity coefficient K is 3000 [kN/mm].

In FIG. 10, θx which is approximately 0.11 [radian] is equivalent to an angle at which the strip tip is bitten, and this is equivalent to a biting angle θi. θx which is 0.00 [radian] represents an angle at which the strip tip has reached the exit of work rolls.

As depicted in FIG. 10, there is a kiss roll load from the initial period of biting to θx which is approximately 0.020 to 0.040 [radian], and the traction coefficient μrt is kept low at a small value due to the presence of the kiss roll load.

In addition, whereas the traction coefficient μrt changes in the process after the strip tip starts being bitten until the strip advances to the work roll exit side, the maximum value μrtmax of the traction coefficient μrt when the strip tip is in the roll bite is approximately 0.070 when the mill longitudinal rigidity coefficient K is 6000 [kN/mm], approximately 0.060 when the mill longitudinal rigidity coefficient K is 4000 [kN/mm], and approximately 0.060 when the mill longitudinal rigidity coefficient K is 3000 [kN/mm].

Then, whereas FIG. 10 depicts a tendency of the traction coefficient μrt that it decreases as the work roll balance force Pb increases, there is less influence of the work roll balance force Pb on the maximum value μrtmax when the exit-side strip thickness ho is 1.2 [mm], which is a condition of FIG. 10.

Figure 11:
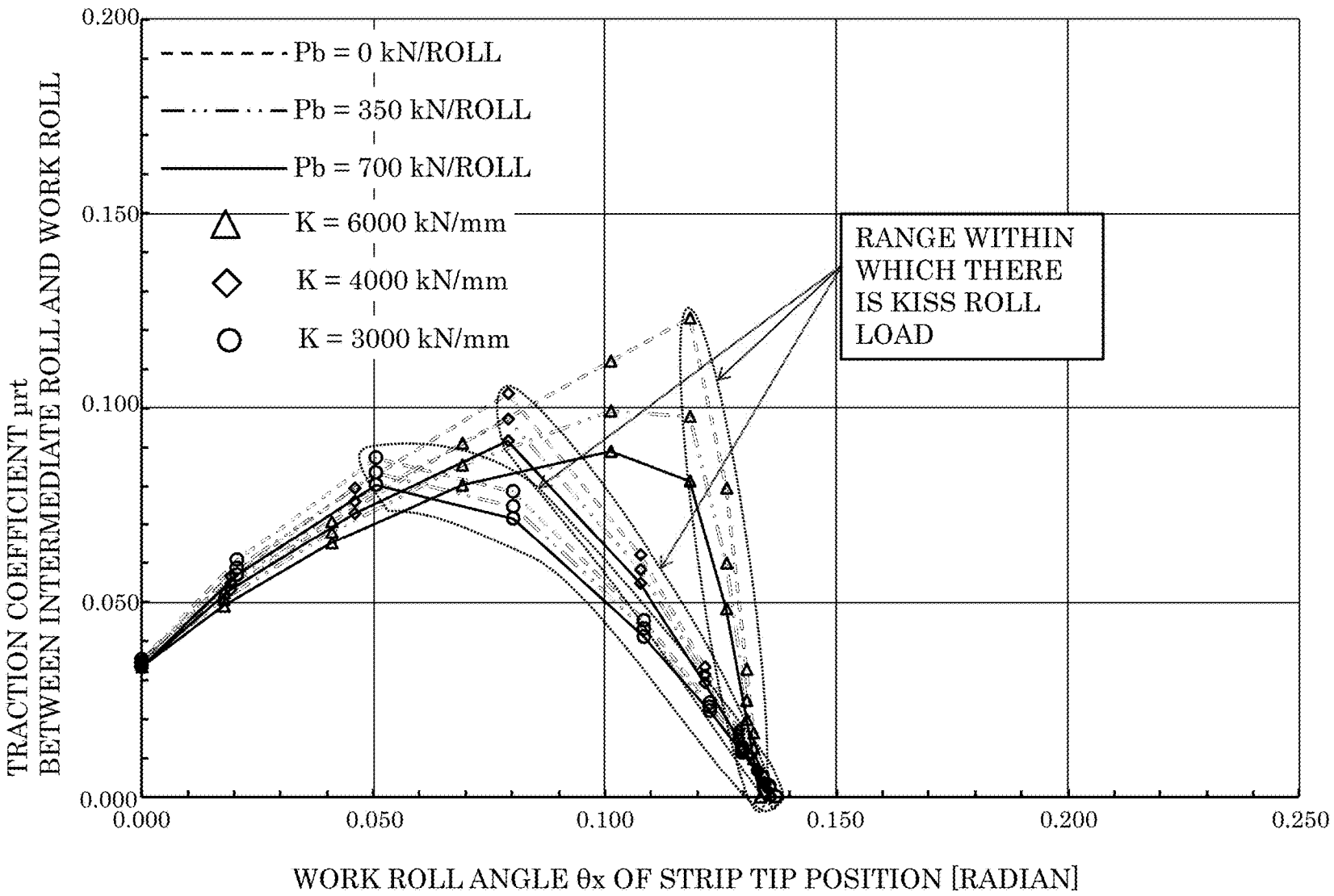
FIG. 11 is a figure depicting the relation between the strip tip position in a roll bite and the traction coefficient between an intermediate roll and a work roll.

FIG. 11 is a figure depicting the relation between the work roll angle θx of the tip position of a rolled material in a roll bite and the traction coefficient μrt between an intermediate roll and a work roll. FIG. 11 depicts results obtained under a condition where the exit-side strip thickness and width are 2.0 [mm] and 1250 [mm], respectively. In FIG. 11, θx which is approximately 0.135 [radian] is equivalent to the biting angle θi.

As depicted in FIG. 11, whereas when the mill longitudinal rigidity coefficient K is 6000 [kN/mm], there is a kiss roll load from the initial period of biting to Ox which is approximately 0.120 [radian], the traction coefficient μrt increases rapidly, and the maximum value μrtmax becomes approximately 0.120 at θx which is approximately 0.120 [radian] at which there is no longer the kiss roll load.

In addition, when the mill longitudinal rigidity coefficient K is 4000 [kN/mm], there is a kiss roll load from the initial period of biting to θx which is approximately 0.080 [radian], and the traction coefficient μrt is kept low at a small value due to the presence of the kiss roll load. The maximum value μrtmax of the traction coefficient μrt is approximately 0.105, and is generated at θx which is approximately 0.080 [radian].

When the mill longitudinal rigidity coefficient K is 3000 [kN/mm], there is a kiss roll load from the initial period of biting to θx which is approximately 0.050 [radian], and the traction coefficient μrt is kept low at a small value due to the presence of the kiss roll load. The maximum value μrtmax of the traction coefficient μrt is approximately 0.090, and is generated at θx which is approximately 0.050 [radian].

In this manner, the range within which there is a kiss roll load widens as the mill longitudinal rigidity coefficient K decreases. In addition, it can be known that it is possible to make the maximum value μrtmax smaller depending on the work roll balance force Pb, and the influence of the work roll balance force Pb is more significant in a case where the exit-side strip thickness ho is 2.0 [mm] as compared to a case where exit-side strip thickness ho is 1.2 [mm].

Figure 12:
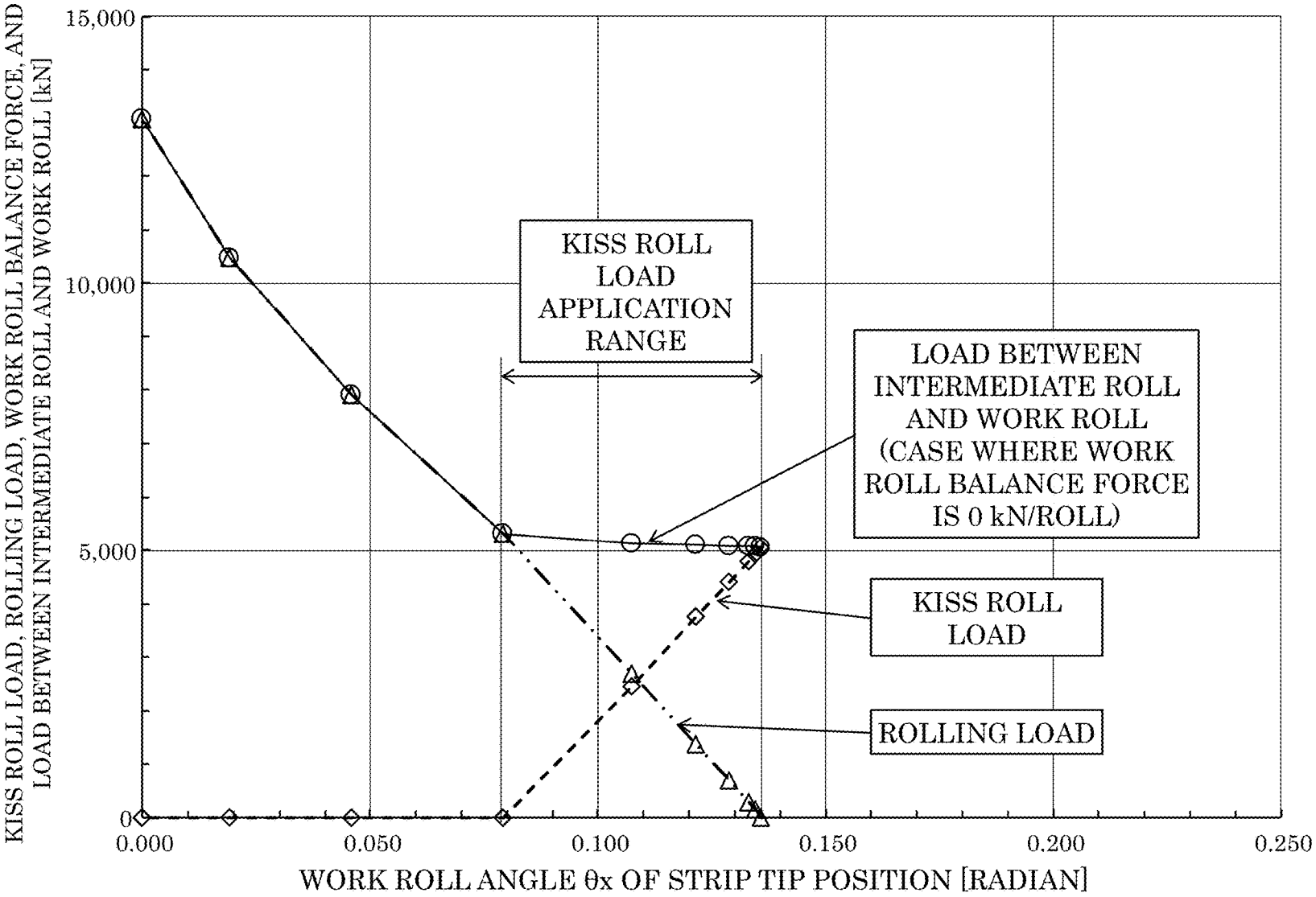
FIG. 12 is a figure depicting the relation between the strip tip position in a roll bite and a load between an intermediate roll and a work roll.

FIG. 12 is a figure depicting the relation between θx and each load. FIG. 12 depicts results obtained under a condition where the thickness and width of a rolled material are 2.0 [mm] and 1250 [mm], respectively, and the mill longitudinal rigidity coefficient K is 4000 [kN/mm], and the work roll balance force Pb is 0 [kN/roll].

As depicted in FIG. 12, in a case where there is kiss roll, a kiss roll load is applied already when the strip tip is bitten by the work rolls, and the kiss roll load decreases as the strip tip moves into the roll bite. On the other hand, the rolling load Pr gradually increases as the strip tip moves into the roll bite.

Accordingly, it can be known that in the kiss roll load application range, the load P (≈Pr+Pk+Pb) between the intermediate roll and the work roll can be kept large even if the rolling load Pr is a relatively small value, and thus it becomes possible to lower the traction coefficient μrt.

Figure 13:
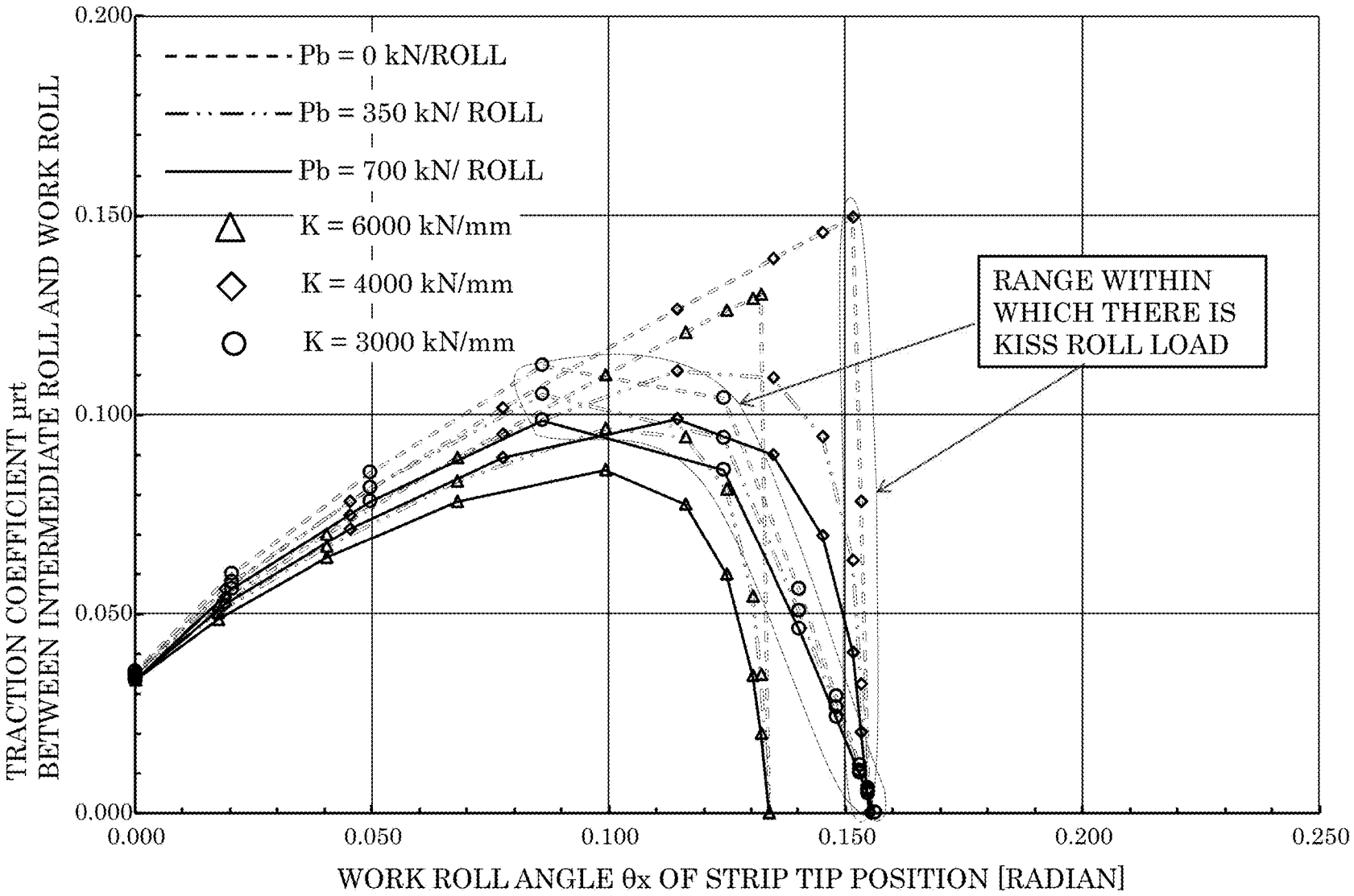
FIG. 13 is a figure depicting the relation between the strip tip position in a roll bite and the traction coefficient between an intermediate roll and a work roll.

FIG. 13 is a figure depicting the relation between the work roll angle θx of the tip position of a rolled material in a roll bite and the traction coefficient μrt between an intermediate roll and a work roll. FIG. 13 depicts results obtained under a condition where the exit-side strip thickness and width are 3.0 [mm] and 1600 [mm], respectively.

As depicted in FIG. 13, when the mill longitudinal rigidity coefficient K is 6000 [kN/mm], θx which is approximately 0.133 [radian] is equivalent to the biting angle θi. There is not a kiss roll load from the initial period of biting. The maximum value μrtmax of the traction coefficient μrt is approximately 0.130, and is generated at θx of biting which is approximately 0.133 [radian].

In addition, when the mill longitudinal rigidity coefficient K is 4000 [kN/mm], θx which is approximately 0.155 [radian] is equivalent to the biting angle θi. There is a slight kiss roll load only in the initial period of biting, and the maximum value μrtmax of the traction coefficient μrt is approximately 0.150, and is generated at θx of biting which is approximately 0.151 [radian].

When the mill longitudinal rigidity coefficient K is 3000 [kN/mm], θx which is approximately 0.155 [radian] is equivalent to the biting angle. There is a kiss roll load until θx which is approximately 0.090 [radian], and the maximum value μrtmax of the traction coefficient μrt is approximately 0.110, and is generated at θx of biting which is approximately 0.090 [radian].

In addition, the maximum value μrtmax can be lowered depending on the work roll balance force Pb. In a case where the exit-side strip thickness ho is 3.0 [mm], there is greater influence of the work roll balance force Pb as compared to a case where the exit-side strip thickness ho is 1.2 [mm] or the exit-side strip thickness ho is 2.0 [mm].

Figure 14:
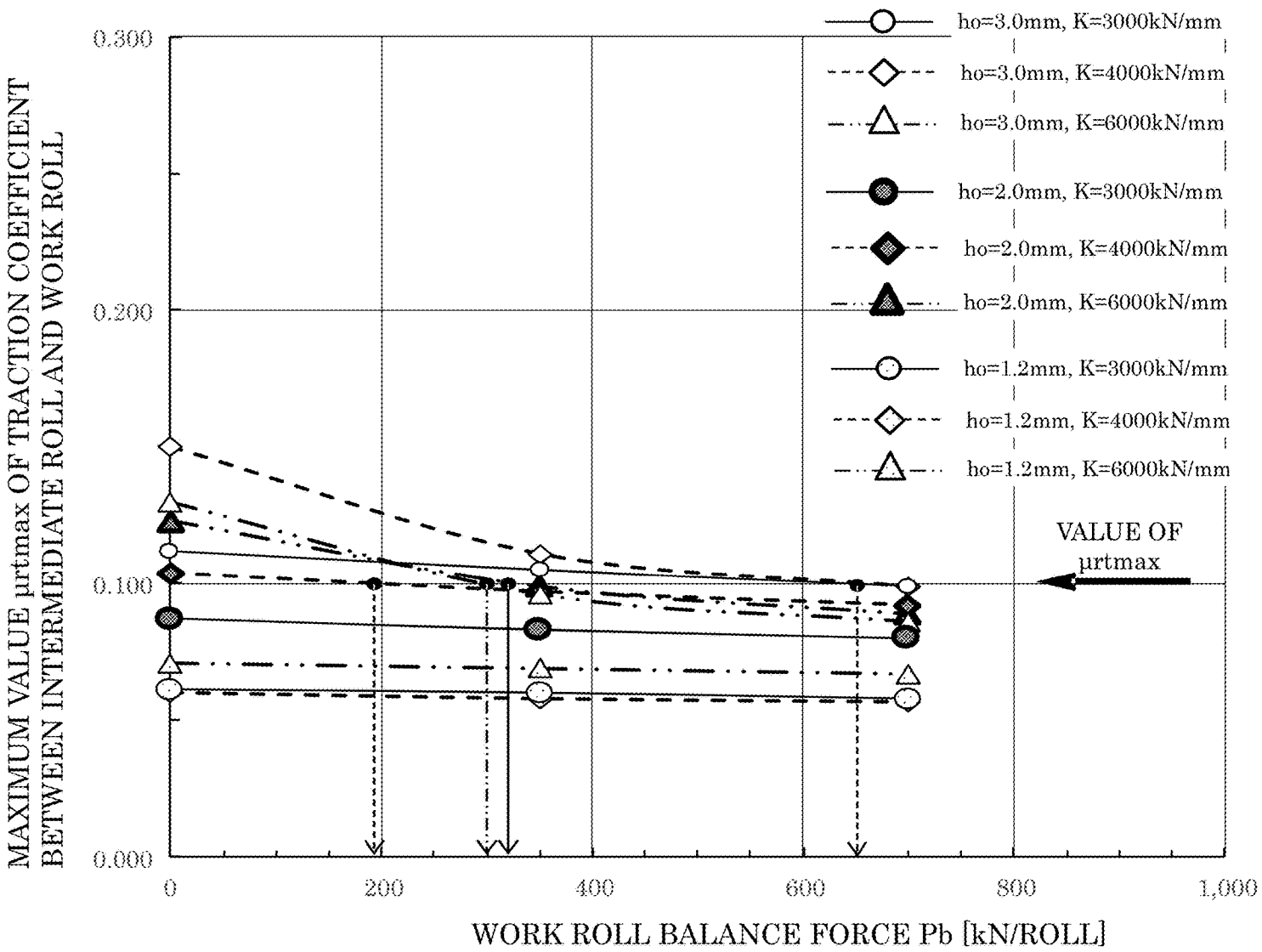
FIG. 14 is a figure depicting the relation between the strip tip position in a roll bite and the maximum value of the traction coefficient between an intermediate roll and a work roll.

FIG. 14 is a figure depicting the relation between the work roll balance force Pb and the maximum value μrtmax of the traction coefficient between an intermediate roll and a work roll. As depicted in FIG. 14, the influence of the work roll balance force Pb on the maximum value μrtmax is as follows.

When the exit-side strip thickness ho is thick, and is 3.0 [mm], it becomes possible to further lower the maximum value μrtmax by increasing the work roll balance force Pb. On the other hand, when the exit-side strip thickness ho is thin, and is 1.2 [mm], there is less influence of the work roll balance force Pb on the maximum value μrtmax.

In addition, the influence of the mill longitudinal rigidity coefficient K on the maximum value μrtmax is as follows. How the mill longitudinal rigidity coefficient K influences the maximum value μrtmax differs depending on the exit-side strip thickness ho. When the exit-side strip thickness ho is thin, and is 1.2 [mm], the maximum value μrtmax lowers as the mill longitudinal rigidity coefficient K lowers, but when the exit-side strip thickness ho is thick, and is 3.0 [mm], the relation between the mill longitudinal rigidity coefficient K and the maximum value μrtmax becomes complicated.

It can be known that both the work roll balance force Pb and the mill longitudinal rigidity coefficient K influence the maximum value μrtmax in this manner.

Here, a limit value μrtcr of the maximum value μrtmax differs depending on the state of two contacting rolls. It is considered that if the traction coefficient μrt is equal to or smaller than 0.10, a significant slide does not occur in most cases. Here, work roll balance force at the time of the maximum value μrtmax is defined as Pbcr1. If it is supposed that the limit value μrtcr of the maximum value μrtmax is 0.10, the work roll balance force when the maximum value μrtmax becomes the limit value μrtcr 0.10 is defined as Pbcr1cr. Pbcr1cr is treated as required limit work roll balance force. By making Pbcr1 equal to or larger than Pbcr1cr, the maximum value μrtmax becomes equal to or smaller than limit value μrtcr 0.10.

Figure 15:
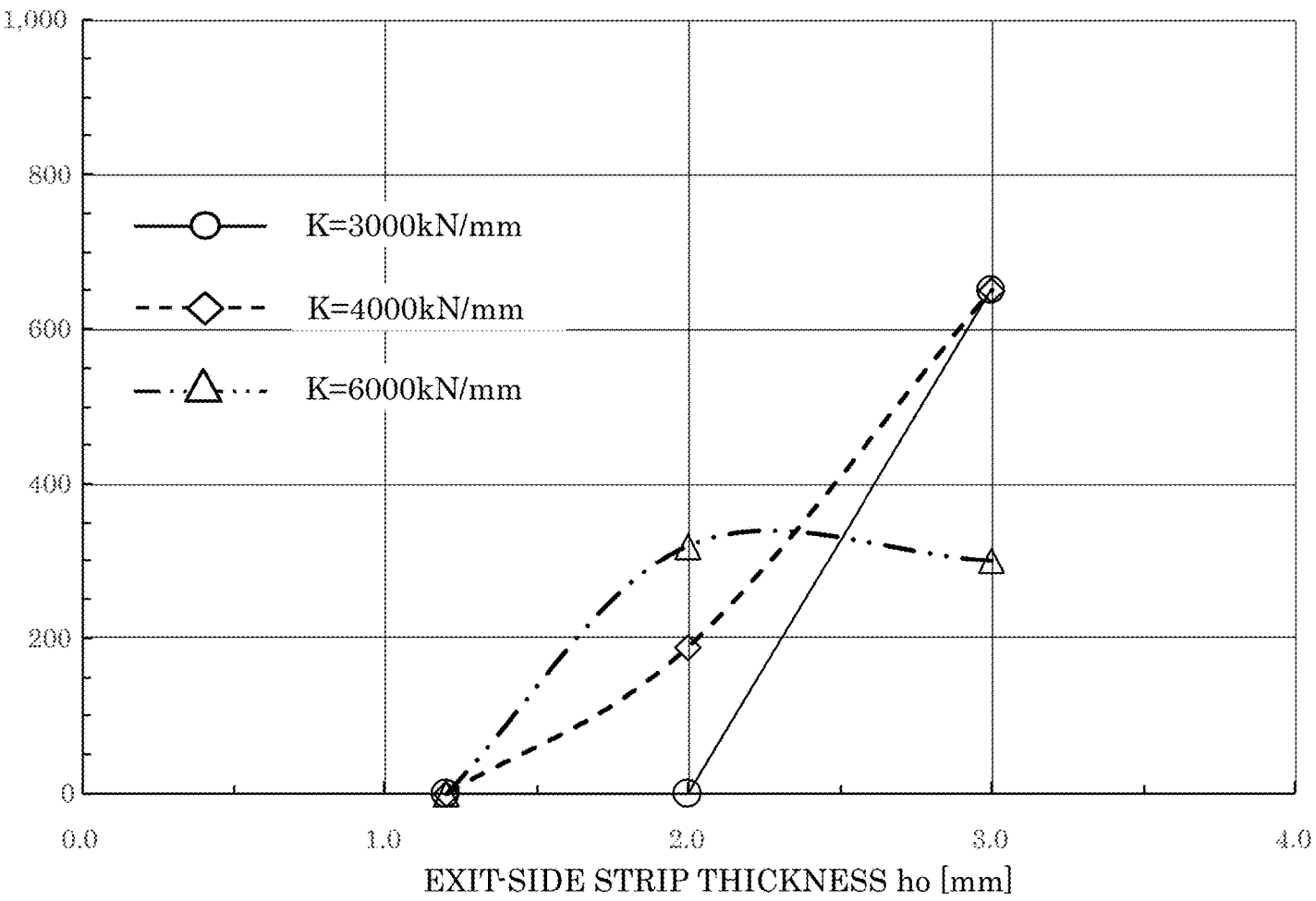
FIG. 15 is a figure depicting the relation between the exit-side thickness of a strip in a roll bite and work roll balance force.

FIG. 15 is a figure depicting the relation between the exit-side strip thickness ho and the required limit work roll balance force Pbcr1cr. FIG. 15 depicts the limit work roll balance force Pbcr1cr when the limit value μrtcr of the maximum value μrtmax becomes 0.10. By making the work roll balance force Pb larger than Pbcr1cr, the maximum value μrtmax becomes equal to or smaller than the limit value μrtcr, and rolling can be continued without occurrence of a significant slide.

As depicted in FIG. 15, the relation between the exit-side strip thickness ho and the limit work roll balance force Pbcr1cr exhibits different tendencies depending on the mill longitudinal rigidity coefficient K, and the limit work roll balance force Pbcr1cr is influenced by the mill longitudinal rigidity coefficient K.

For example, whereas when the mill longitudinal rigidity coefficient K is 3000 [kN/mm], the limit work roll balance force Pbcr1cr is 0 [kN/roll] within the range of the exit-side strip thickness ho from 1.2 [mm] to 2.0 [mm], the limit work roll balance force Pbcr1cr increases suddenly when the exit-side strip thickness ho increases from 2.0 [mm] to 3.0 [mm].

In addition, whereas when the mill longitudinal rigidity coefficient K is 4000 [kN/mm], the limit work roll balance force Pbcr1cr gradually increases when the exit-side strip thickness ho changes from 1.2 [mm] to 2.0 [mm], the limit work roll balance force Pbcr1cr increases suddenly when the exit-side strip thickness ho increases from 2.0 [mm] to 3.0 [mm].

Furthermore, when the mill longitudinal rigidity coefficient K is 6000 [kN/mm], the limit work roll balance force Pbcr1cr remains constant when the exit-side strip thickness ho increases from 2.0 [mm] to 3.0 [mm].

Other than the limit work roll balance force Pbcr1cr, there is a limit of the work roll balance force. When the diameter of work rolls is small, the work roll balance force Pb cannot be increased due to the strength of the bearings or the roll necks, and thus there is limit work roll balance force Pbcr2 that is determined from a constraint in terms of the strength.

When the required limit work roll balance force Pbcr1cr is a value larger than the limit work roll balance force Pbcr2 that is determined from the constraint in terms of the strength, work roll driving by using work rolls with a relatively large diameter is adopted preferably. In contrast to this, when work rolls with a relatively large diameter are used, and the work rolls are driven directly, it is possible to transfer large rolling torque Tr. For example, when the exit-side strip thickness ho is equal to or larger than 3.0 [mm], the required limit work roll balance force Pbcr1cr increases when K is 3000 [kN/mm] or 4000 [kN/mm], but by adopting a condition of work roll driving in which work rolls with a relatively large diameter are used, there is not inter-roll transfer of the rolling torque Tr, and thus it is possible to eliminate constraints of the traction coefficient μrt and the maximum value μrtmax.

Here, the mill longitudinal rigidity coefficient K is explained. The mill longitudinal rigidity coefficient K is expressed as P/δ when the rolling load Pr is P, and an elastic deformation amount of each section of the rolling mill when P is applied is δ.

The mill longitudinal rigidity coefficient K is determined by the rigidity of a group of rolls, housings, rolling devices, bearing housings of rolls, and the like that are included in the rolling mill. The mill longitudinal rigidity coefficient K in the initial period of activation is a certain value, and as the use period of the rolling mill becomes longer, the mill longitudinal rigidity coefficient K lowers. It is considered that this is due to the fact that in the process of use, devices such as the housings, the rolling devices, and the bearing housings are worn, changes occur in the abutting condition of each section, and the mill longitudinal rigidity coefficient K lowers.

Repairs are carried out because, simultaneously with the lowering of the mill longitudinal rigidity coefficient K, differences between elastic deformation amounts on the work side and the drive side occur to make rolling unstable. Due to the repairs, the mill longitudinal rigidity coefficient K returns to a value close to the one in the initial period of activation. It should be noted however that the mill longitudinal rigidity coefficient K cannot recover to reach the one in the initial period of activation.

In this manner, the mill longitudinal rigidity coefficient K changes along with the use, the mill longitudinal rigidity coefficient K is monitored at predetermined intervals in order to continue stable rolling, and repairs are carried out depending on situations. Note that the mill longitudinal rigidity coefficient K cannot typically be adjustment.

In addition, different facilities have different mill longitudinal rigidity coefficients K. For example, the mill longitudinal rigidity coefficient K of a four-stage rolling mill is a value larger than the mill longitudinal rigidity coefficient K of a six-stage rolling mill. The larger the number of rolls is, the smaller the value of the mill longitudinal rigidity coefficient K is.

On the other hand, in a case of intermediate roll driving or backup roll driving, the maximum value μrtmax changes depending on the mill longitudinal rigidity coefficient K. In a case where the maximum value μrtmax inevitably exceeds and becomes larger than the limit value μrtcr, and a significant inter-roll slide occurs inevitably, it becomes not possible to continue rolling.

In view of this, the present inventors have conceived of the idea that by checking the mill longitudinal rigidity coefficient K, determining the required limit work roll balance force Pbcr1cr from the mill longitudinal rigidity coefficient K and rolling conditions, and setting the work roll balance force Pb to a value equal to or larger than Pbcr1cr to perform biting of a strip tip, it becomes possible to suppress a significant inter-roll slide. Thereby, the present inventors have conceived of the idea that even when work rolls have a small diameter, and the work rolls themselves cannot be used as driving rolls, rolling becomes possible by intermediate roll driving or backup roll driving.

The present invention has been made on the basis of such findings.

Next, an overview of a rolling facility including a rolling mill of the present embodiment is explained by using FIG. 16 to FIG. 19. FIG. 16 to FIG. 19 are figures depicting an overview of a finishing rolling mill to which the rolling mill according to the present invention is applied.

Figure 16:
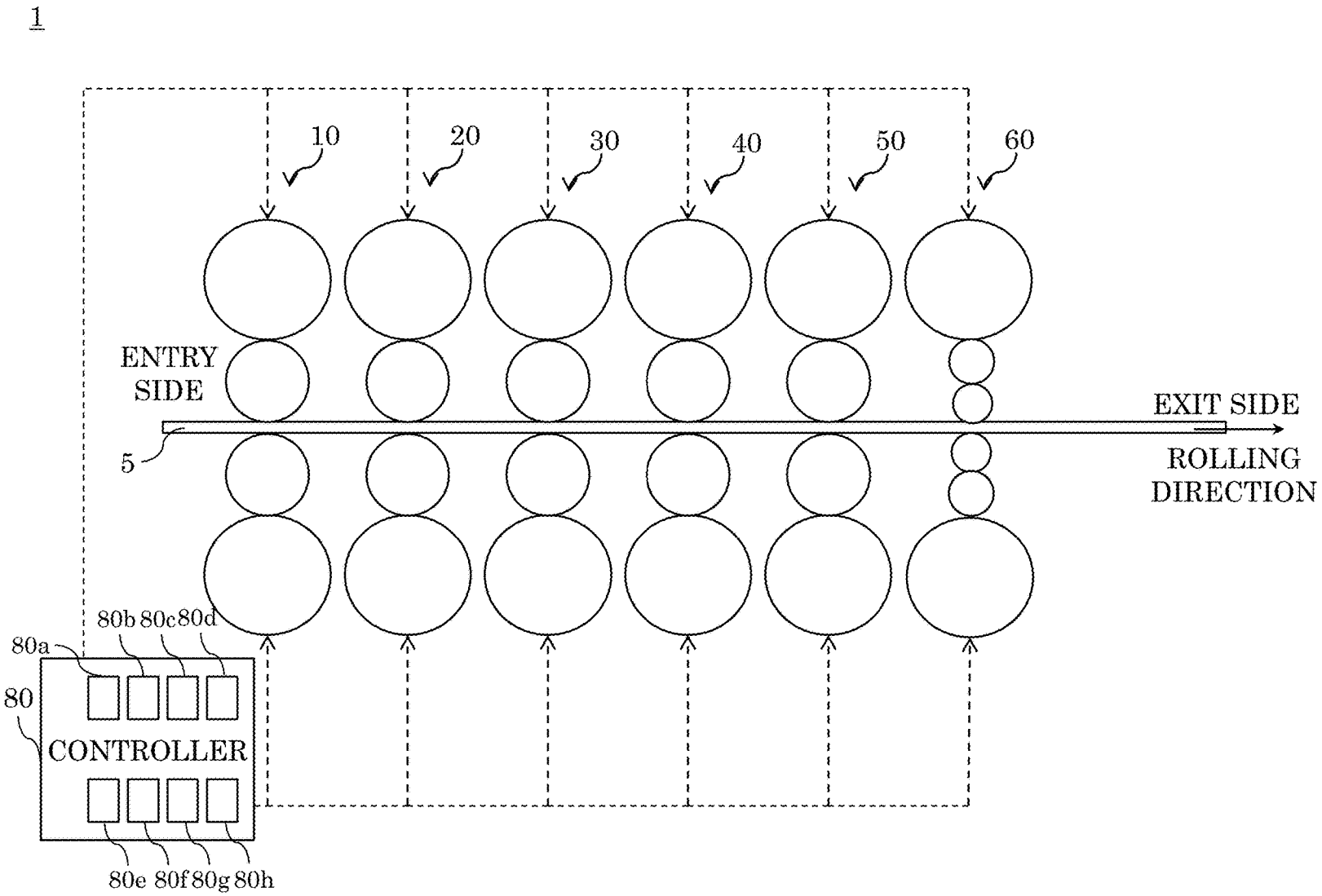
FIG. 16 is a figure depicting an overview of a finishing rolling mill to which a rolling mill according to the present invention is applied.

A rolling facility 1 depicted in FIG. 16 includes a plurality of rolling mills that perform hot rolling of processing a rolled material 5 into a strip. The rolling facility 1 has a controller 80, and six stands which are an F1 stand 10, an F2 stand 20, an F3 stand 30, an F4 stand 40, an F5 stand 50, and an F6 stand 60 from the rolled-material-5 entry side.

Among these, each of the F1 stand 10, the F2 stand 20, the F3 stand 30, the F4 stand 40, the F5 stand 50, and the F6 stand 60, and a portion of the controller 80 that controls a corresponding one of the stands are equivalent to what is called a rolling mill in the present invention, but it is assumed here that the findings mentioned above are applied only to the F6 stand 60.

In FIG. 16, the F1 stand 10, the F2 stand 20, the F3 stand 30, the F4 stand 40, and the F5 stand 50 are four-stage rolling mills, and only the F6 stand 60 at the last stage is a six-stage rolling mill in which small-diameter work rolls are attached.

Figure 17:
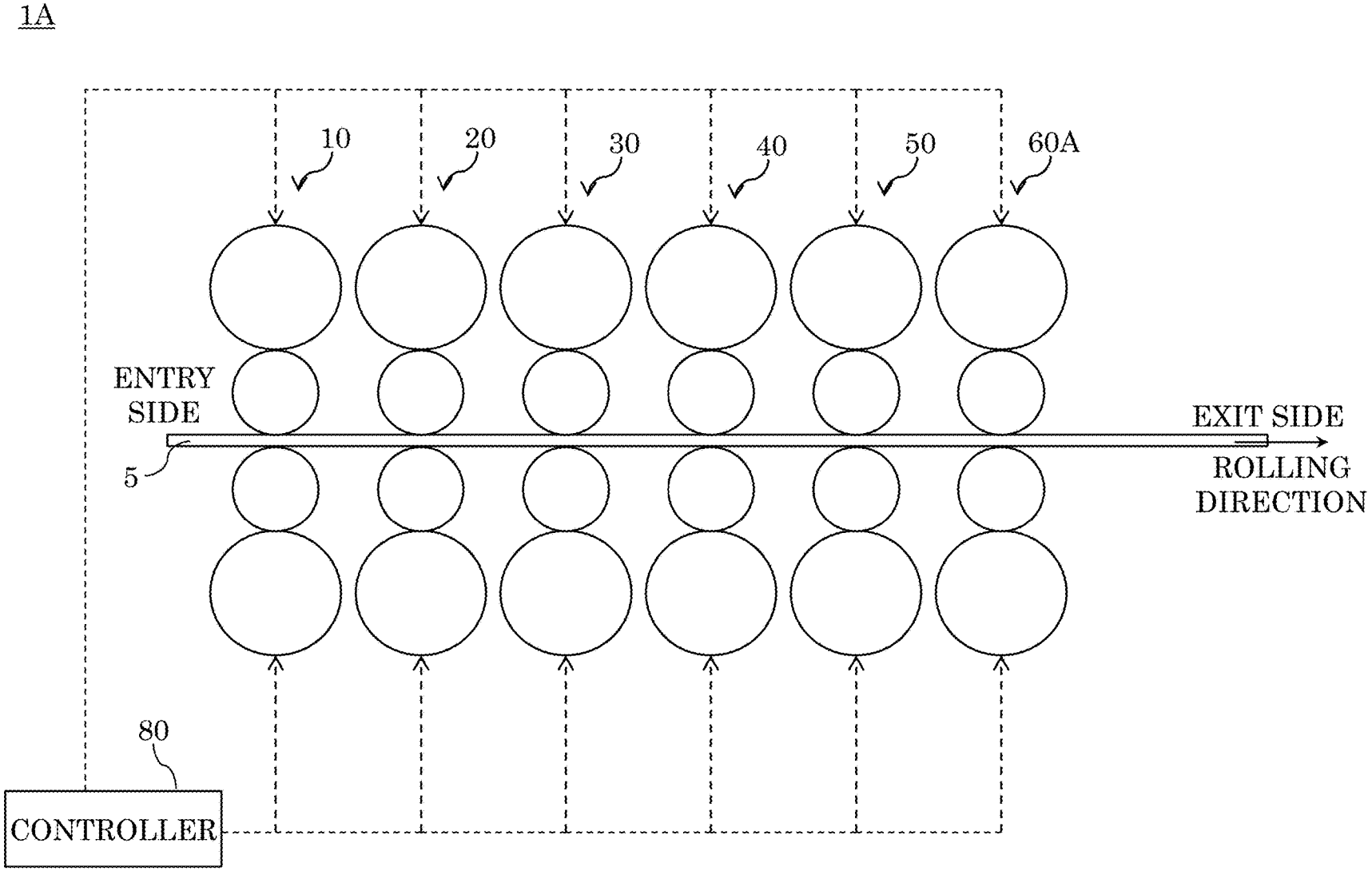
FIG. 17 is a figure depicting another overview of a finishing rolling mill to which the rolling mill according to the present invention is applied.

A rolling facility 1A depicted in FIG. 17 has also a four-stage rolling mill as an F6 stand 60A in which large-diameter work rolls are attached, in addition to the F1 stand 10, the F2 stand 20, the F3 stand 30, the F4 stand 40, and the F5 stand 50.

Figure 18:
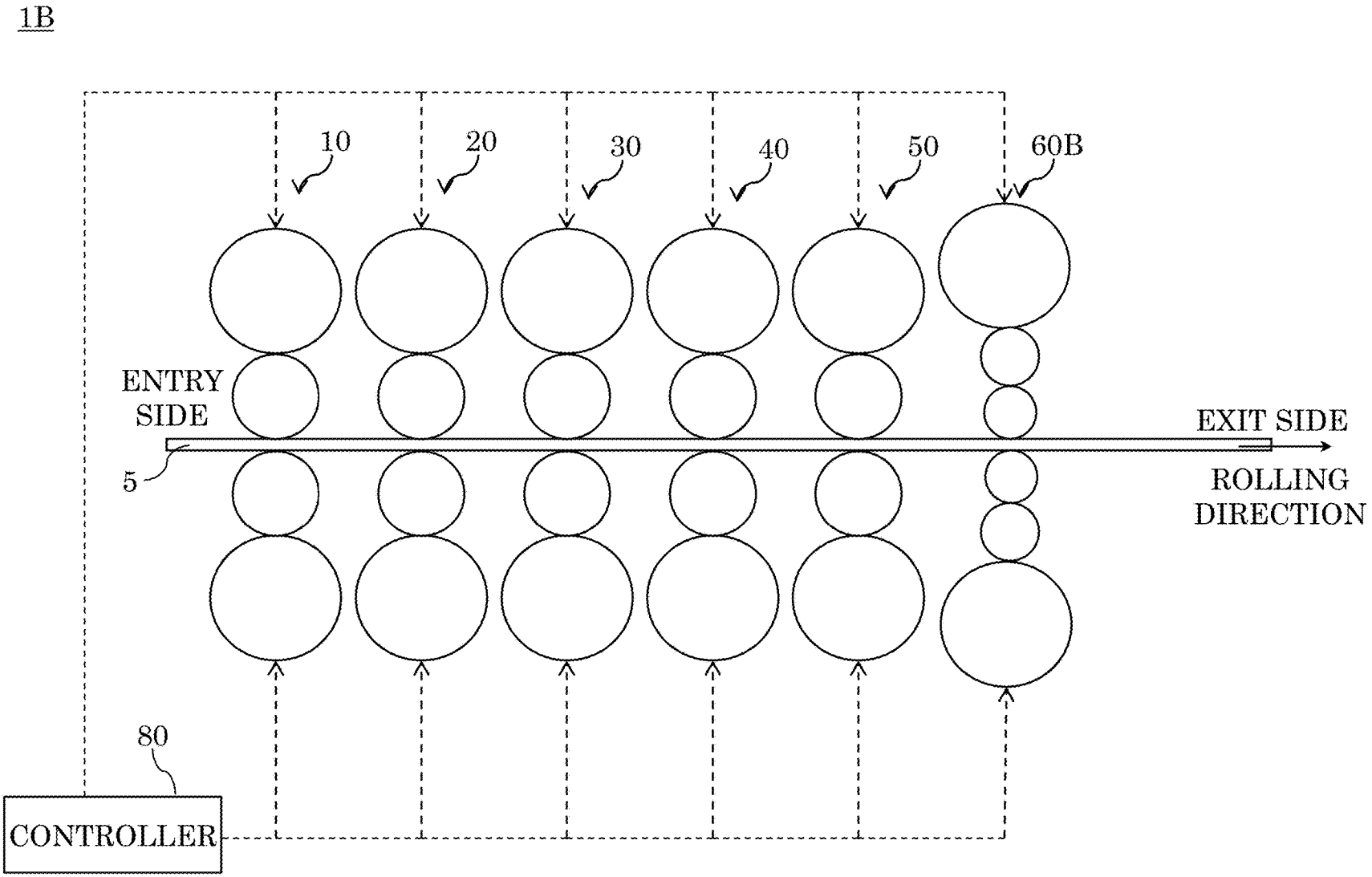
FIG. 18 is a figure depicting another overview of a finishing rolling mill to which the rolling mill according to the present invention is applied.

Furthermore, a rolling facility 1B depicted in FIG. 18 has four-stage rolling mills as the F1 stand 10, the F2 stand 20, the F3 stand 30, the F4 stand 40, and the F5 stand 50, and only an F6 stand 60B at the last stage is a six-stage rolling mill in which large-diameter work rolls are attached. In FIG. 18, the findings mentioned above are applied to the F6 stand 60B.

Figure 19:
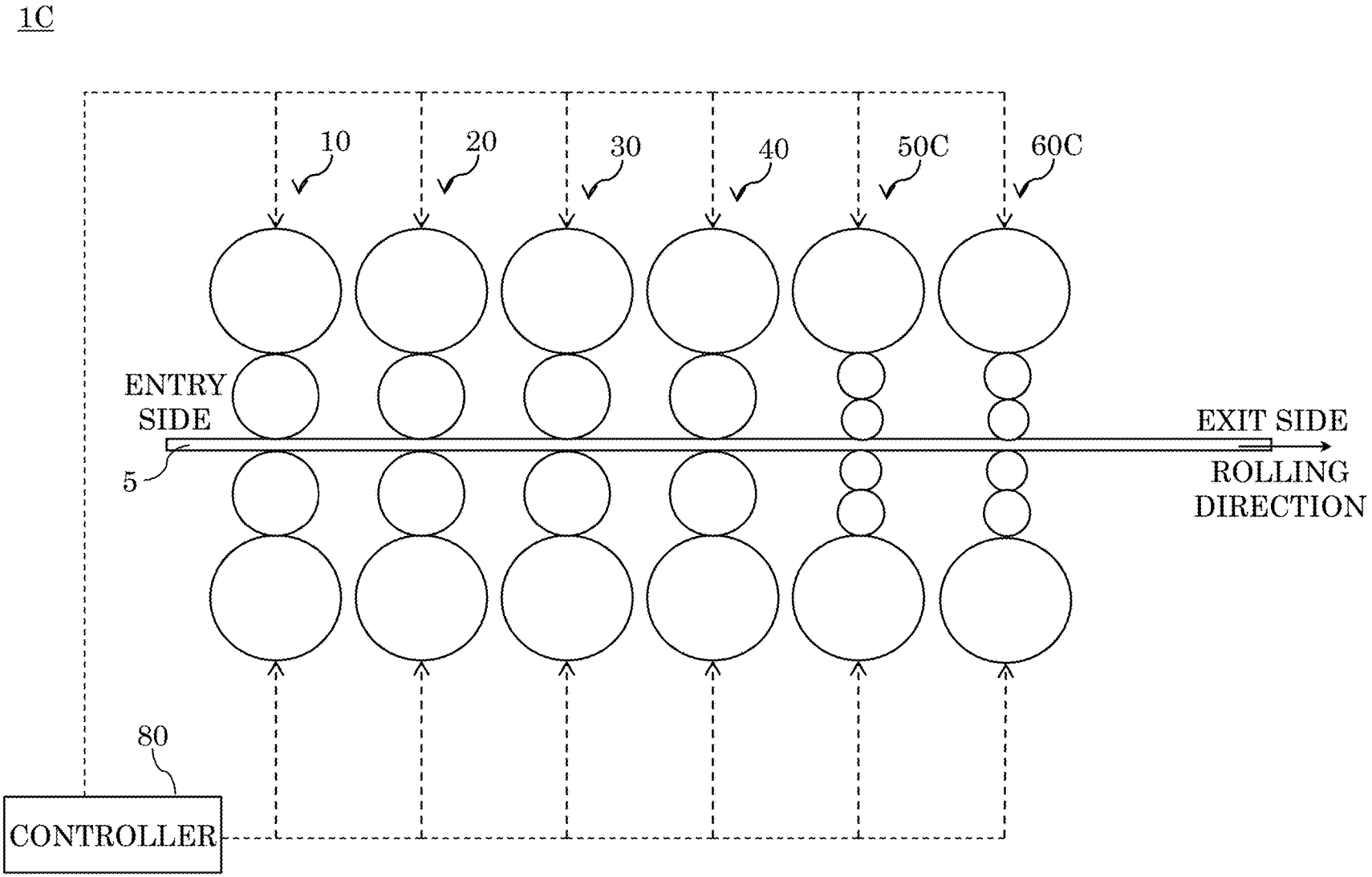
FIG. 19 is a figure depicting another overview of a finishing rolling mill to which the rolling mill according to the present invention is applied.

In a rolling facility 1C depicted in FIG. 19, whereas the F1 stand 10, the F2 stand 20, the F3 stand 30, and the F4 stand 40 are four-stage rolling mills, two stands, an F5 stand 50C and an F6 stand 60C, are six-stage rolling mills in which small-diameter work rolls are attached. In FIG. 19, the findings mentioned above are applied to the F5 stand 50C and the F6 stand 60C.

Note that the numbers of stands included in the rolling facilities 1, 1A, 1B, and 1C are not limited to six like the one depicted in FIG. 16 to FIG. 19, and they can be ones that include at least two stands.

In addition, whereas four-stage rolling mills in which only backup rolls mentioned below are used as one or more pairs of upper and lower rolls provided on sides of the work rolls that are opposite to a rolled material, or six-stage rolling mills in which intermediate rolls and backup rolls mentioned below are used as such one or more pairs of upper and lower rolls are explained in cases of FIG. 16 to FIG. 19 mentioned above, rolling mills which are the subjects of a work roll balance force setting method, a rolling mill running method, and a rolling mill running switching method according to the present invention are not limited to four-stage rolling mills or six-stage rolling mill like the ones mentioned above, and rolling mills including side support rolls that directly contact work rolls, and the like are also suitable application subjects.

In addition, whereas hot rolling mills at a biting step are explained as examples in the embodiment, these are not the sole examples.

Figure 20:
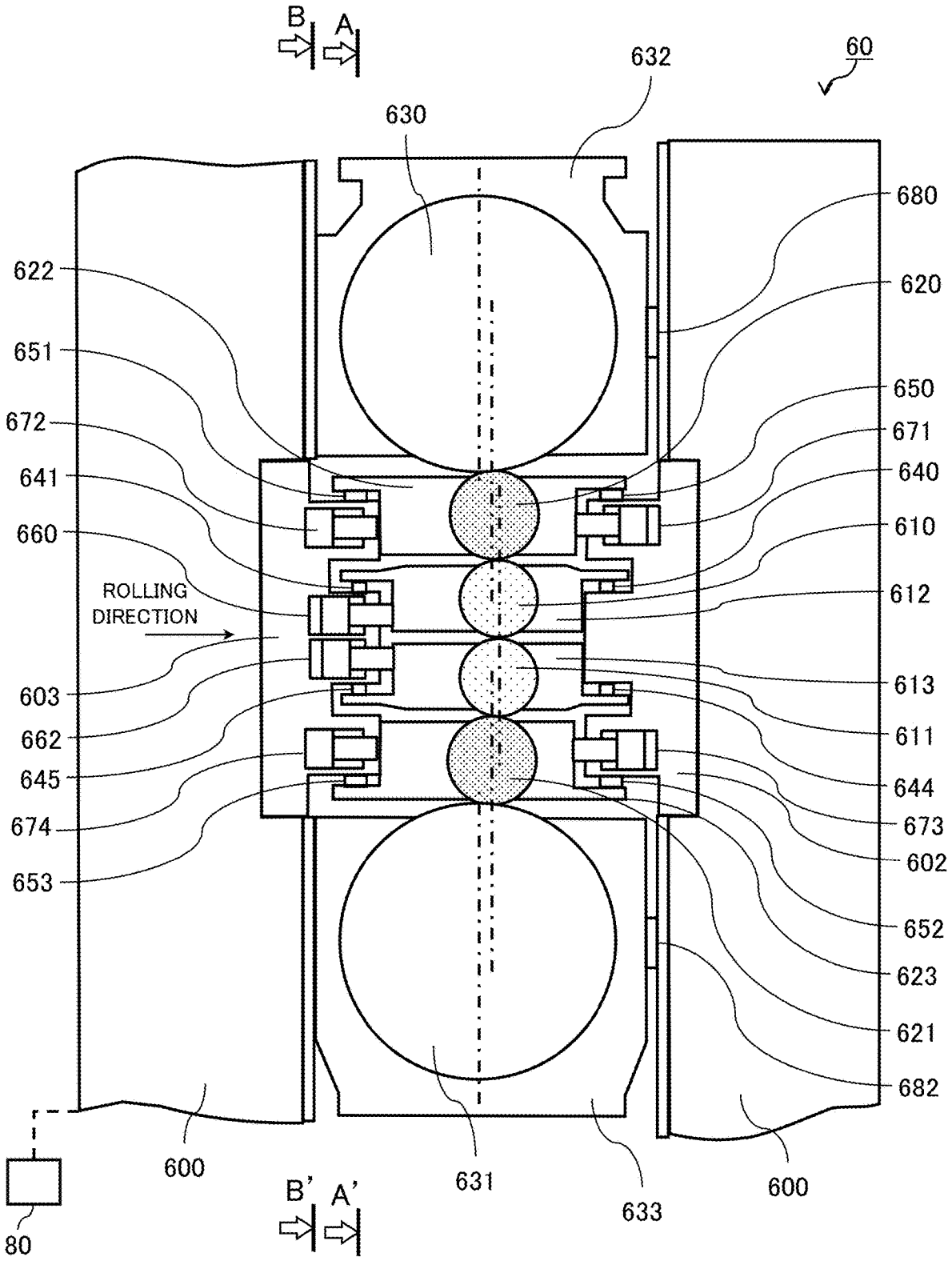
FIG. 20 is a figure depicting a front view of the rolling mill according to the present invention.
Figure 21:
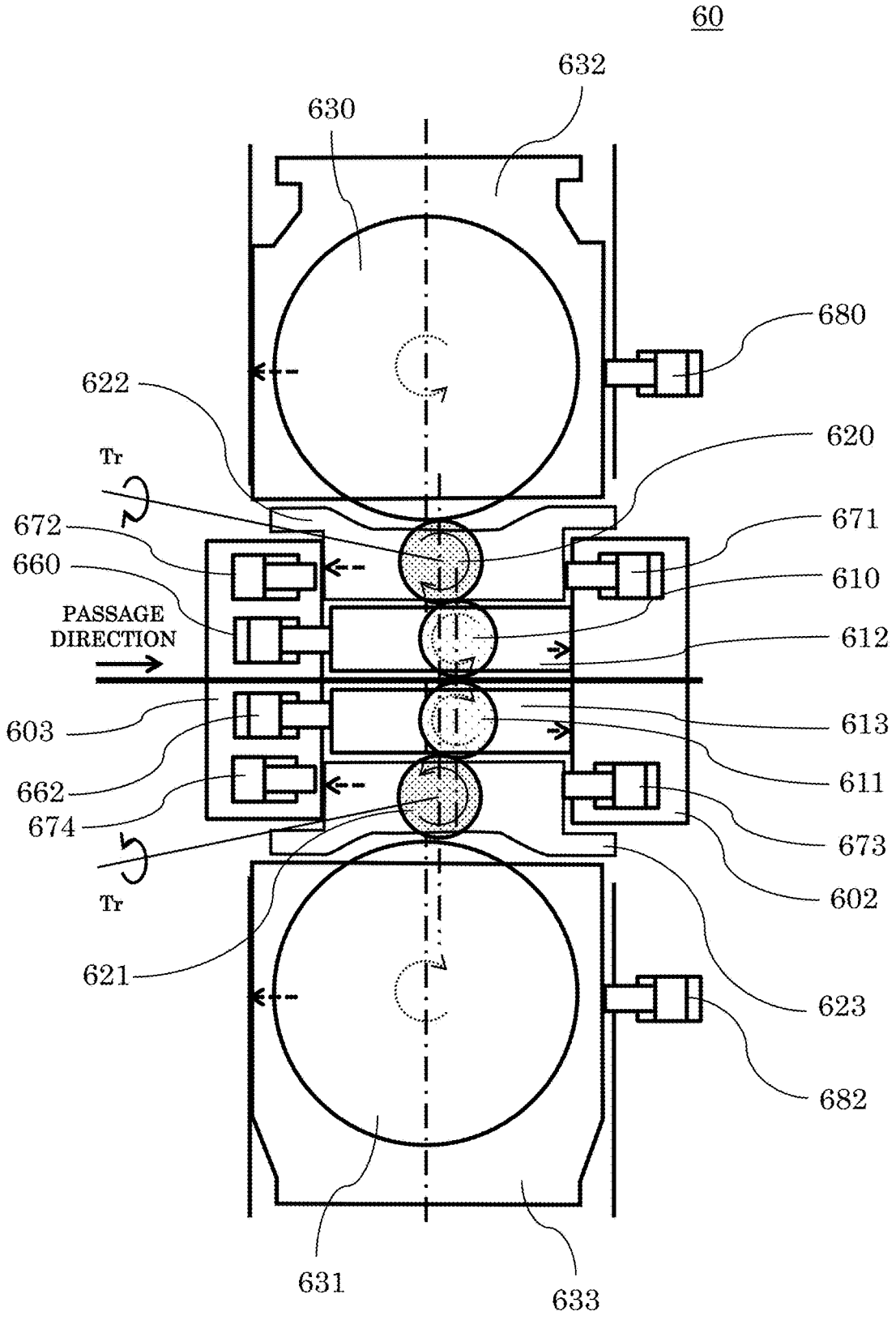
FIG. 21 is a figure depicting a modification example of an entry-side fixation member and an exit-side fixation member shown in FIG. 20.
Figure 22:
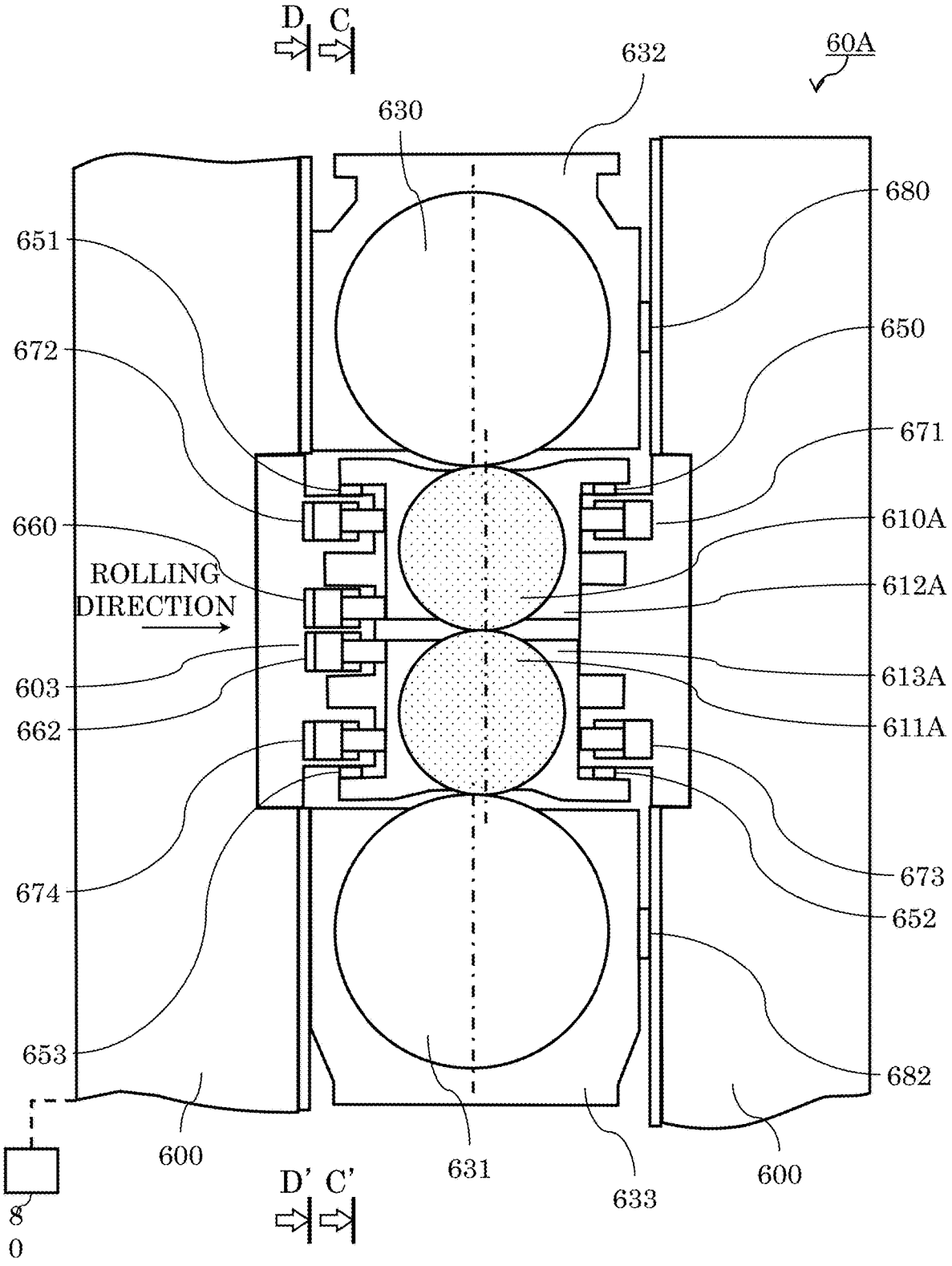
FIG. 22 is a figure depicting another front view of the rolling mill according to the present invention.
Figure 23:
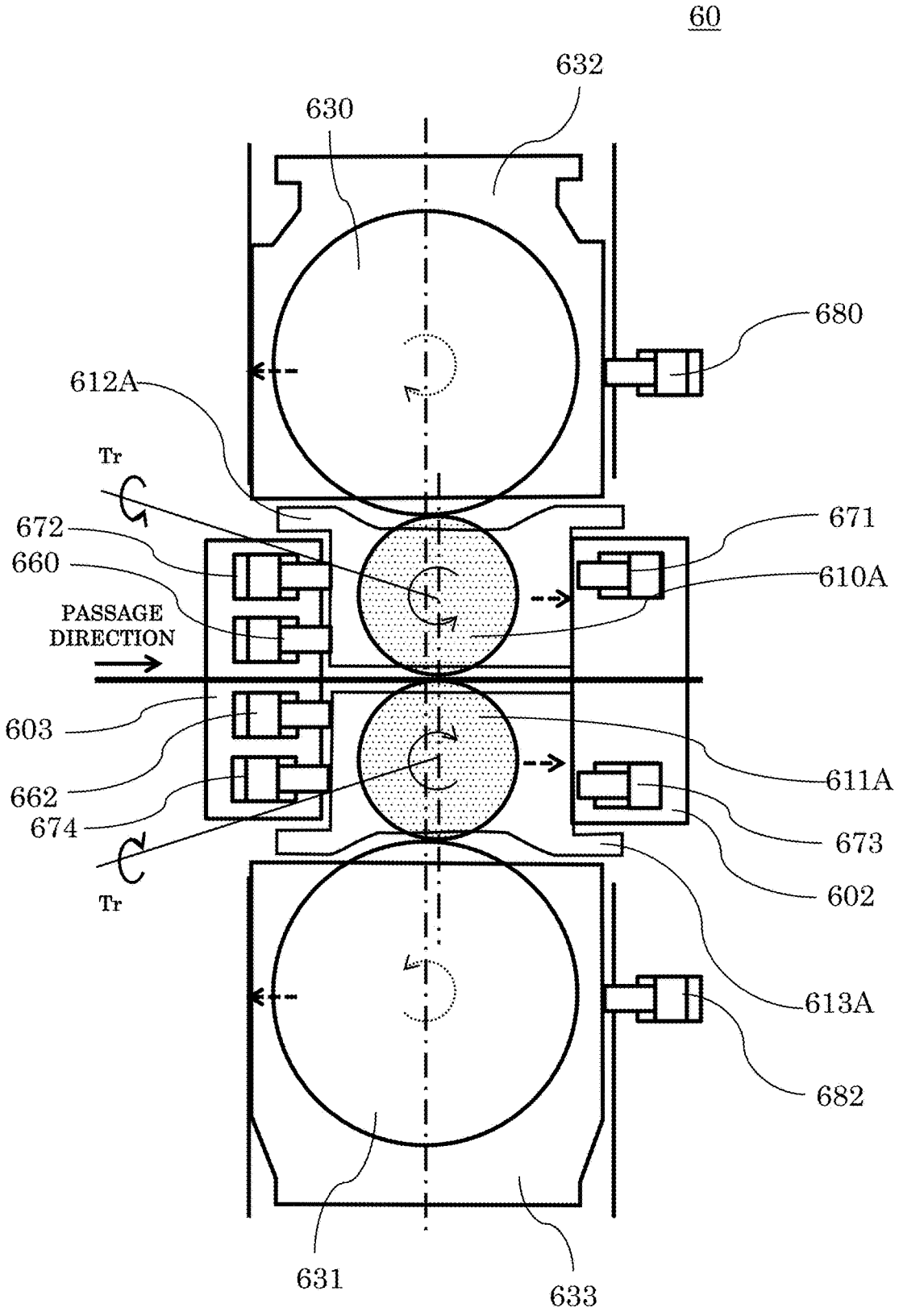
FIG. 23 is a figure depicting a modification example of an entry-side fixation member and an exit-side fixation member shown in FIG. 22.
Figure 24:
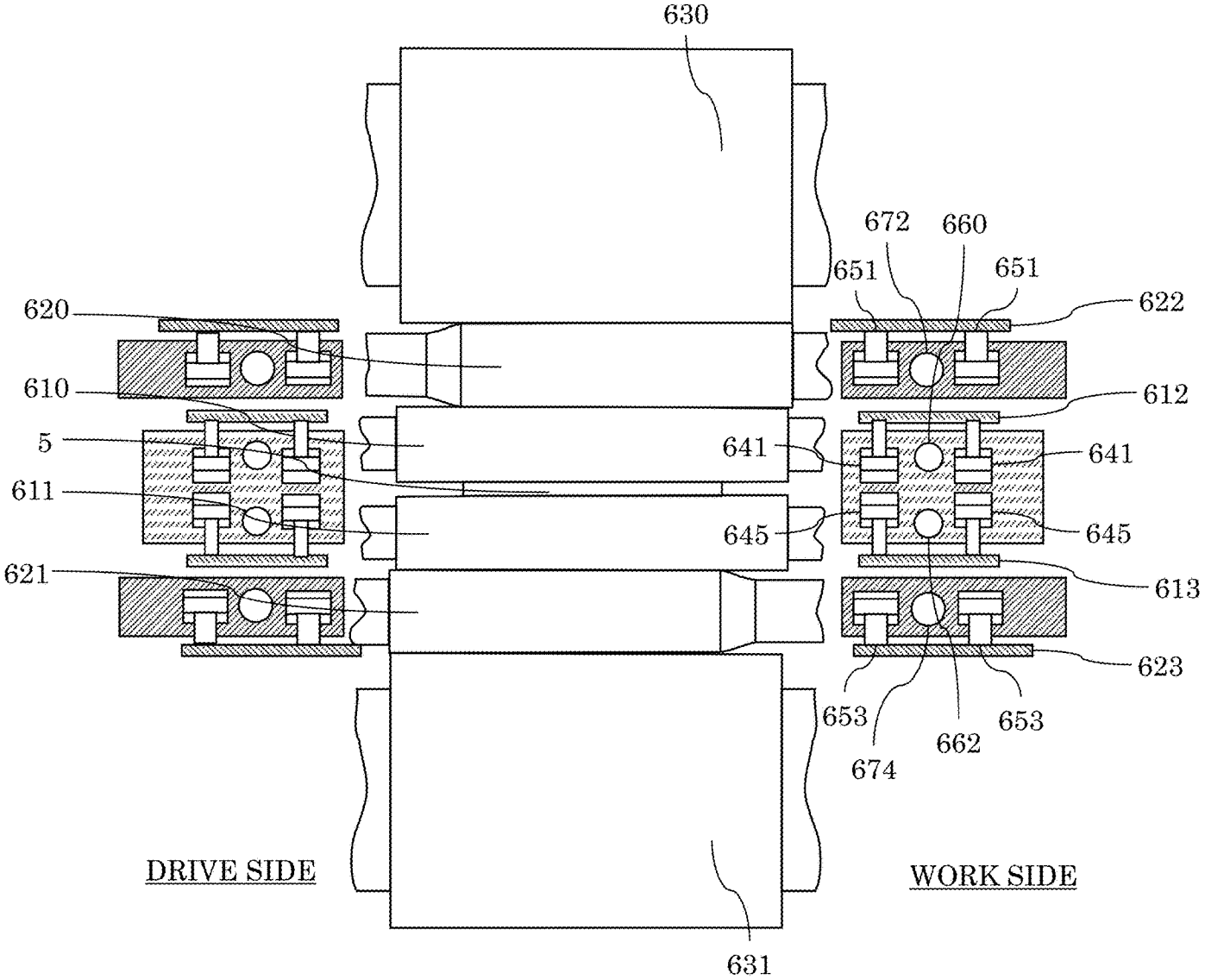
FIG. 24 is a figure of a section taken along a line denoted by arrows A and A' in FIG. 20, and seen in the direction of arrows A and A'.
Figure 25:
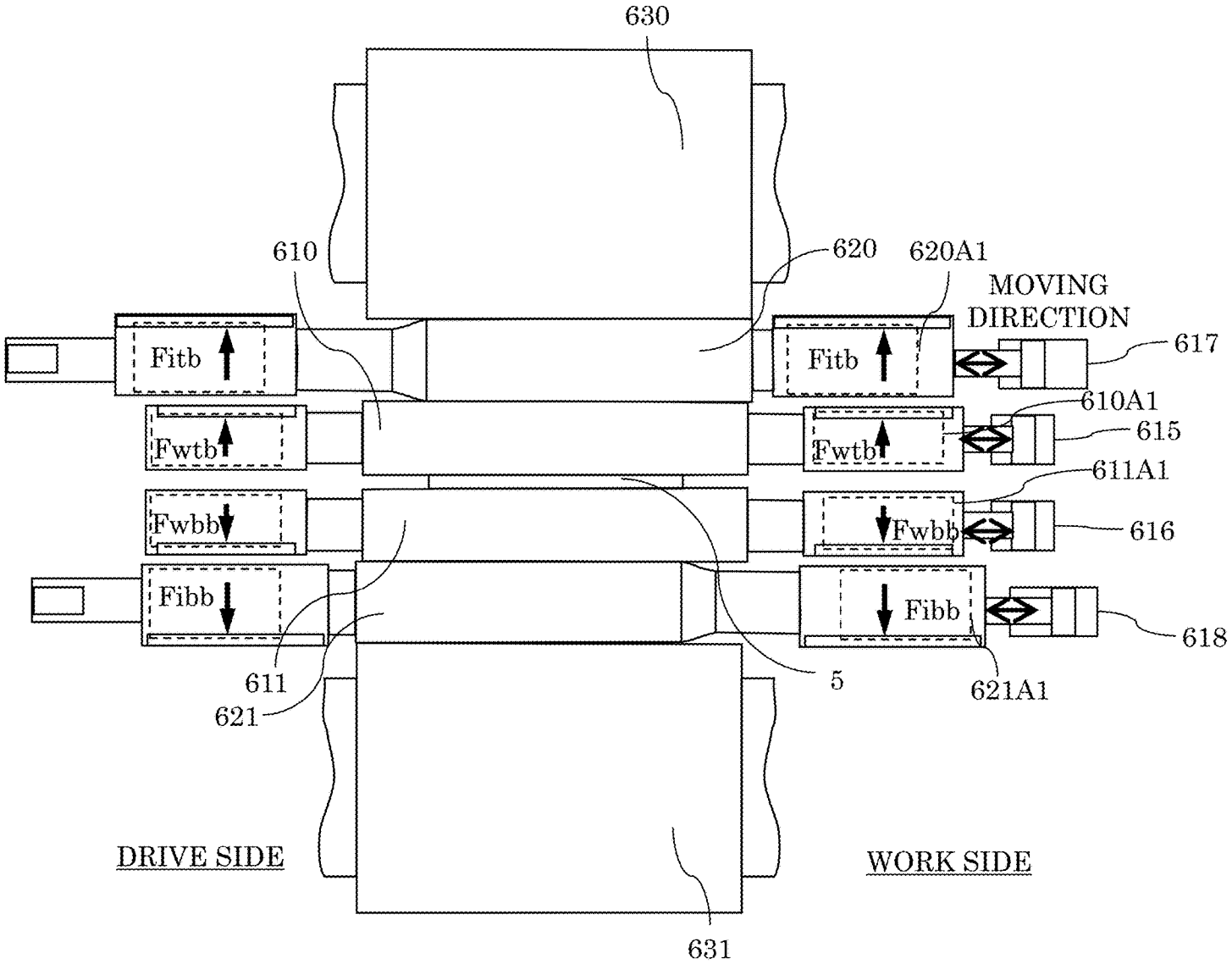
FIG. 25 is a figure of a section taken along a line denoted by arrows B and B' in FIG. 20, and seen in the direction of arrows B and B'.
Figure 26:
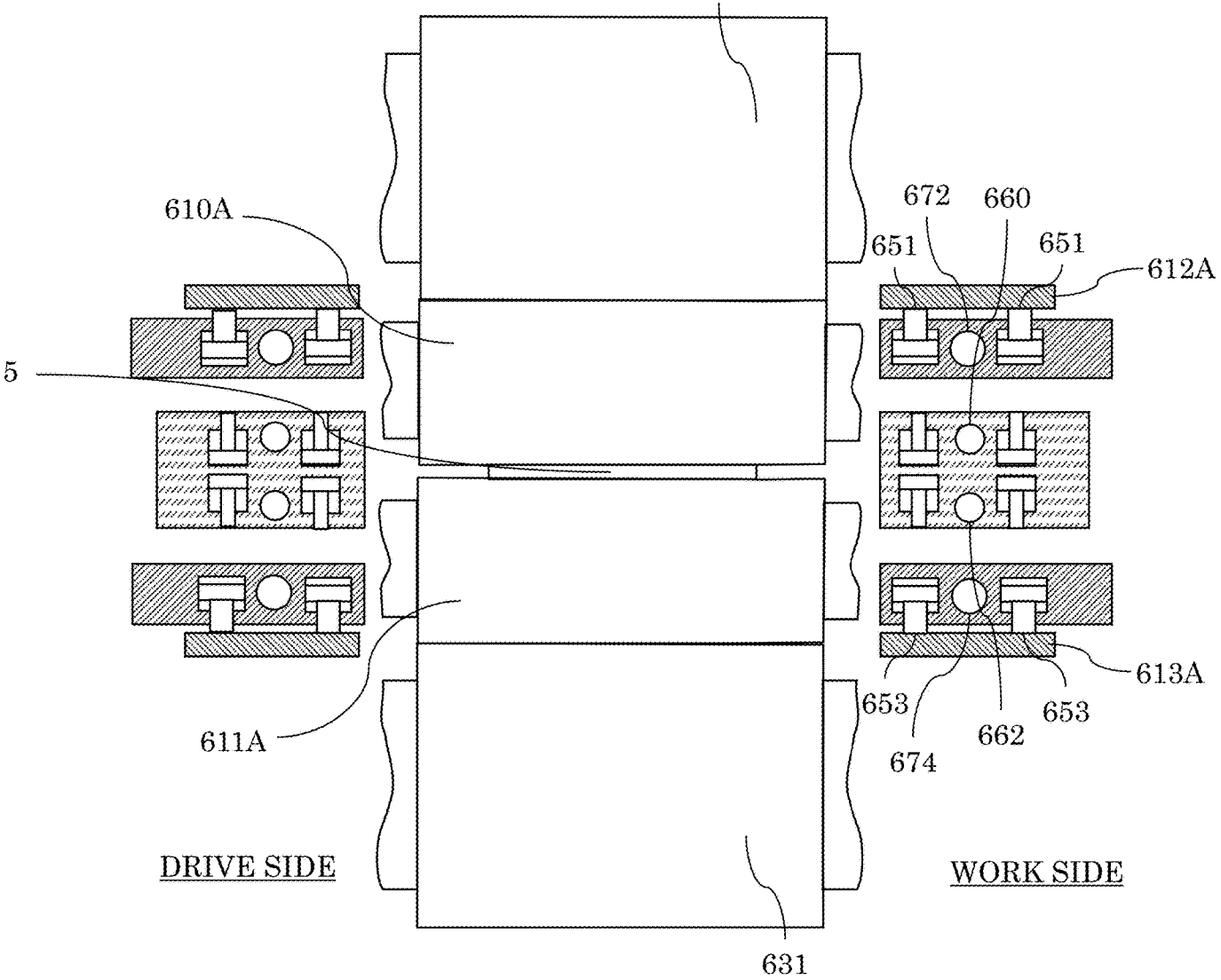
FIG. 26 is a figure of a section taken along a line denoted by arrows C and C' in FIG. 22, and seen in the direction of arrows C and C'.
Figure 27:
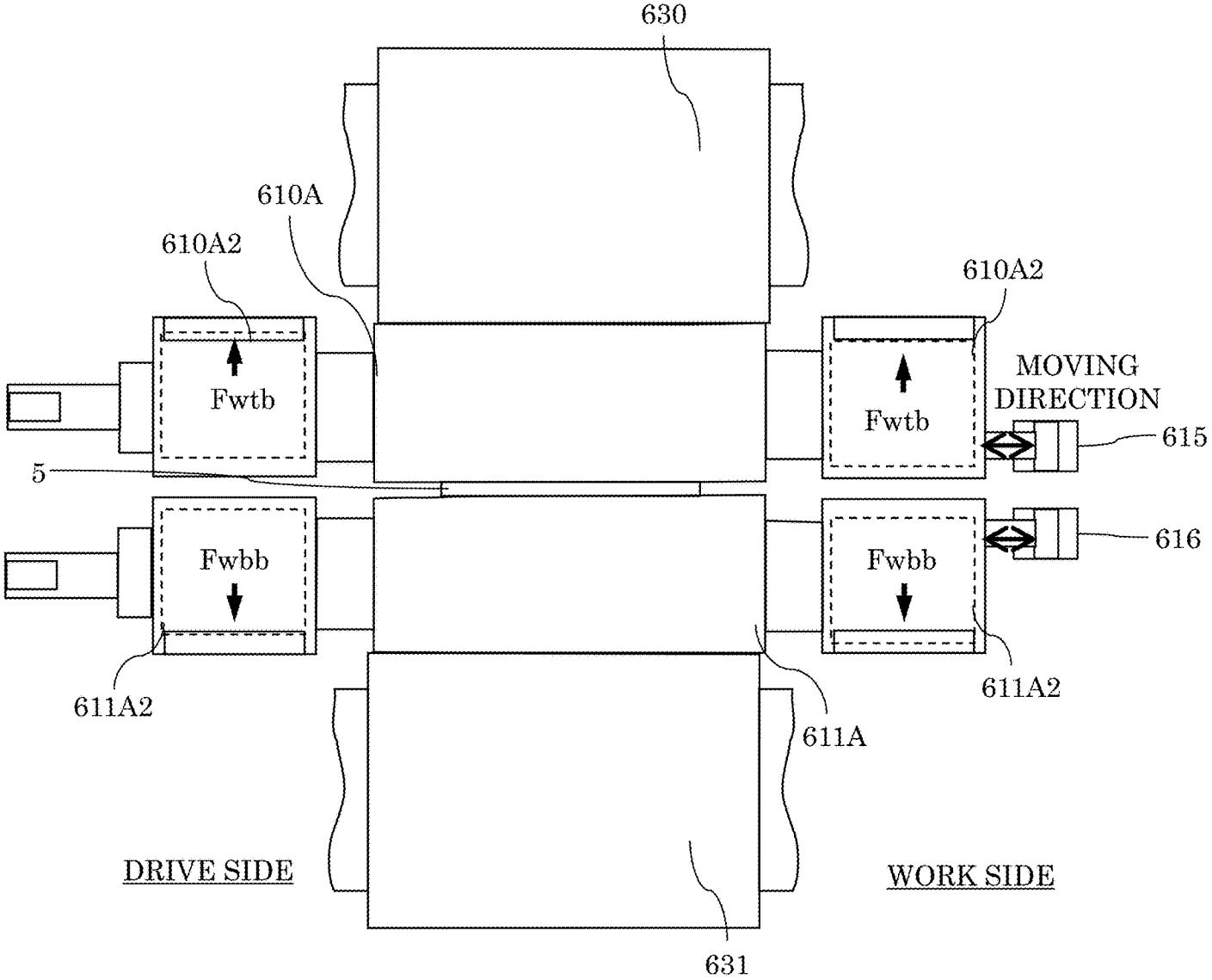
FIG. 27 is a figure of a section taken along a line denoted by arrows D and D' in FIG. 22, and seen in the direction of arrows D and D'.
Figure 28:
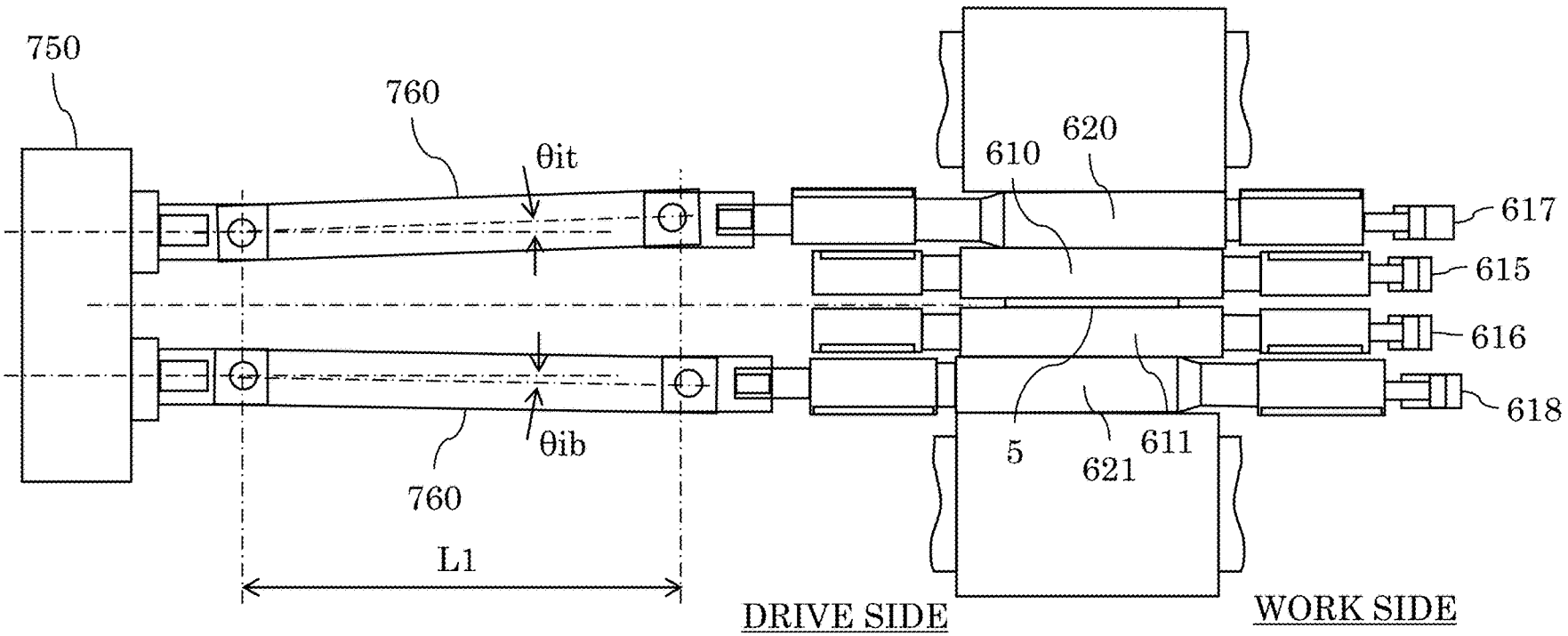
FIG. 28 is a figure depicting a state in the rolling mill according to the present invention where the same type of drive spindle is used.
Figure 29:
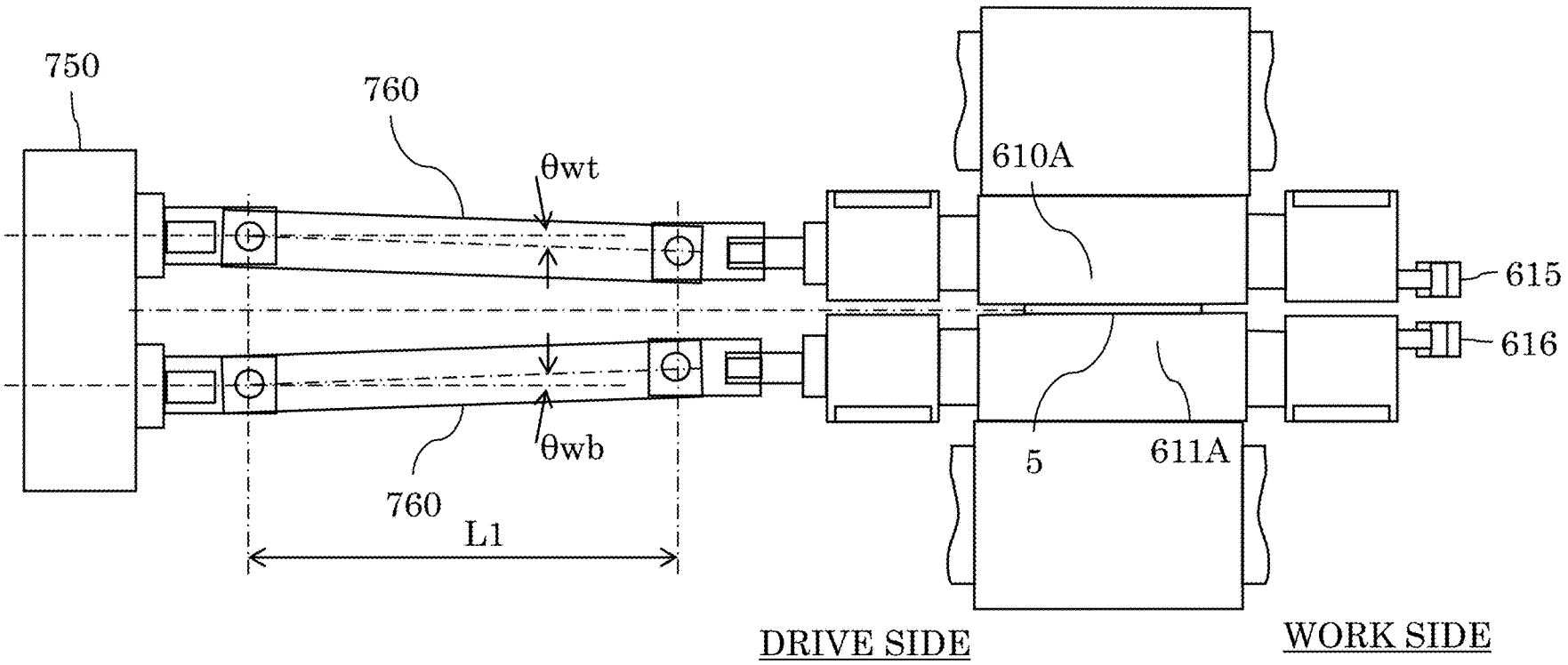
FIG. 29 is a figure depicting a state in the rolling mill according to the present invention where the same type of drive spindle is used.

Next, an overview of the rolling mill according to the present invention is explained by using FIG. 20 to FIG. 29. FIG. 20 is a figure depicting a front view of the rolling mill according to the present invention. FIG. 21 is a figure depicting a modification example of an entry-side fixation member and an exit-side fixation member shown in FIG. 20. FIG. 22 is a figure depicting another front view of the rolling mill according to the present invention. FIG. 23 is a figure depicting a modification example of an entry-side fixation member and an exit-side fixation member shown in FIG. 22. FIG. 24 is a figure of a section taken along a line denoted by arrows A and A' in FIG. 20, and seen in the direction of arrows A and A'. FIG. 25 is a figure of a section taken along a line denoted by arrows B and B' in FIG. 20, and seen in the direction of arrows B and B'. FIG. 26 is a figure of a section taken along a line denoted by arrows C and C' in FIG. 22, and seen in the direction of arrows C and C'. FIG. 27 is a figure of a section taken along a line denoted by arrows D and D' in FIG. 22, and seen in the direction of arrows D and D'. FIG. 28 and FIG. 29 are figures depicting states where the same type of drive spindle is used.

Note that whereas the F6 stands 60 and 60A in the rolling facility 1 depicted in FIG. 16 and the rolling facility 1A depicted in FIG. 17 are explained as examples in FIG. 20 to FIG. 29, the rolling mill according to the present invention can be applied also to any stand of the F1 stand 10, the F2 stand 20, the F3 stand 30, the F4 stand 40, the F5 stands 50 and 50C, and the F6 stands 60B and 60C depicted in FIG. 16, and the like, and further to other stands.

In addition, whereas a case of intermediate roll driving is explained, the present invention can be applied also to backup roll driving.

As depicted in FIG. 20 and FIG. 21, the F6 stand 60 which is an example of the rolling mill according to the present embodiment is a six-stage rolling mill that rolls the rolled material 5, and has housings 600, the controller 80, and a hydraulic device 90 which is not depicted.

The housings 600 include: a pair of an upper work roll 610 and a lower work roll 611; and a pair of an upper intermediate roll 620 and a lower intermediate roll 621 that are provided on sides of the upper work roll 610 and the lower work roll 611 that are opposite to the rolled material 5, and support the upper work roll 610 and the lower work roll 611 by contacting them. Furthermore, the housings 600 include a pair of an upper backup roll 630 and a lower backup roll 631 that support the upper intermediate roll 620 and the lower intermediate roll 621 by contacting them.

In contrast to this, the F6 stand 60A which is another example of the rolling mill according to the present embodiment depicted in FIG. 22 and FIG. 23 is a four-stage rolling mill that rolls the rolled material 5.

As depicted in FIG. 22, the F6 stand 60A includes: a pair of an upper work roll 610A and a lower work roll 611A with a diameter larger than the diameter of the work rolls 610 and 611; and a pair of the upper backup roll 630 and the lower backup roll 631 that are provided on sides of the upper work roll 610A and the lower work roll 611A that are opposite to the rolled material 5, and support the upper work roll 610A and the lower work roll 611A by contacting them.

The work rolls 610 and 611 and the intermediate rolls 620 and 621, and the work rolls 610A and 611A can be replaced with each other. If equipment related the work rolls 610 and 611 and the intermediate rolls 620 and 621 in FIG. 20 is replaced with equipment related to the work rolls 610A and 611A, the F6 stand 60A depicted in FIG. 22 is formed. If the equipment related to the work rolls 610A and 611A is replaced with the equipment related the work rolls 610 and 611 and the intermediate rolls 620 and 621 in FIG. 22, the F6 stand 60 depicted in FIG. 20 is formed.

In the F6 stand 60A depicted in FIG. 22, a direct driving mode in which the work rolls 610A and 611A themselves are driven is used suitably. In the F6 stand 60 depicted in FIG. 20, an indirect driving mode in which the rolling torque Tr of the upper intermediate roll 620 and the lower intermediate roll 621 is supplied to the upper work roll 610 and the lower work roll 611 to drive the upper work roll 610 and the lower work roll 611 is used suitably. Accordingly, replacement is performed at the time of a running switch.

Thereby, it is made possible to switch between the small-diameter work rolls 610 and 611 and the large-diameter work rolls 610A and 611A without changing hydraulic rolling devices, passage line adjusting devices, or the like that are located on or under the upper backup roll 630 and the lower backup roll 631 because such replacement does not accompany significant positional shifts of the upper backup roll 630 and the lower backup roll 631 in the upward/downward direction.

Returning to FIG. 20, on the work side of axial end sections of the upper work roll 610 in the rolls, a bearing 610A1 (see FIG. 25) that shifts in the roll-axis direction along with the upper work roll 610, and receives a load from the roll is provided, and the bearing 610A1 is supported by a work-side upper work roll bearing housing 612. Similarly, on the drive side also, a bearing 610A1 (see FIG. 25) that shifts in the roll-axis direction along with the upper work roll 610, and receives a load from the roll is provided, and the bearing 610A1 is supported by a drive-side upper work roll bearing housing 612.

Similarly, the lower work roll 611 also has bearings 611A1 provided at its axial end sections on both the drive side and the work side, and these bearings are supported by the work-side and drive-side lower work roll bearing housings 613, respectively.

In the present embodiment, the upper work roll 610 is configured to be able to shift in the roll-axis direction due to a shift cylinder 615 like the one depicted in FIG. 25 via an work side upper work roll bearing housing 612. Similarly, the lower work roll 611 is also configured to be able to shift in the roll-axis direction due to a shift cylinder 616 like the one depicted in FIG. 25 via an work side lower work roll bearing housing 613A.

In addition, as depicted in FIG. 24 and FIG. 25, tapered sections are provided at a drive-side end section of the upper intermediate roll 620, and an work side end section of the lower intermediate roll 621, and the upper intermediate roll 620 and the lower intermediate roll 621 are point-symmetric. In addition, the upper intermediate roll 620 is configured to be able to shift in the roll-axis direction due to a shift cylinder 617 like the one depicted in FIG. 25, and the lower intermediate roll 621 is configured to be able to shift in the roll-axis direction due to a shift cylinder 618 like the one depicted in FIG. 25.

Returning to FIG. 20, an exit-side fixation member 602 is fixed to a housing 600 on the rolled-material-5 exit side. An entry-side fixation member 603 is fixed to a housing 600 on the rolled-material-5 entry side such that the entry-side fixation member 603 is opposite to the exit-side fixation member 602.

As depicted in FIG. 20 and FIG. 24, in the F6 stand 60, on both the work side and the drive side, upper work roll bending cylinders 640, and upper work roll bending cylinders 641 support the upper work roll bearing housings 612. Two upper work roll bending cylinders 640 are provided in the roll-axis direction of the exit-side fixation member 602, and two upper work roll bending cylinders 641 are provided in the roll-axis direction of the entry-side fixation member 603. By driving these cylinders as appropriate, bending force is applied vertically to the bearings 610A1 of the upper work roll 610.

Similarly, on both the work side and the drive side, a lower work roll bending cylinder 644 provided to the exit-side fixation member 602, and a lower work roll bending cylinder 645 provided to the entry-side fixation member 603 support the lower work roll bearing housings 613, and by driving these cylinders as appropriate, bending force is applied to the bearings of the lower work roll 611 vertically.

Furthermore, as depicted in FIG. 20 and FIG. 24, for the purpose of preventing backlashes, an upper-work-roll bearing-housing anti-backlash cylinder 660 that applies horizontal force, specifically pressing force in the rolling direction, to the upper work roll 610 via liners (not depicted in figures) of the upper work roll bearing housings 612, and presses the bearings 610A1 against the housings 600 is provided to the entry-side fixation member 603 on the rolled-material-5 entry side. One upper-work-roll bearing-housing anti-backlash cylinder 660 is provided in the roll-axis direction.

Similarly, one lower-work-roll bearing-housing anti-backlash cylinder 662 that applies pressing force in the rolling direction to the lower work roll 611 via liners of the lower work roll bearing housings 613, and presses the bearings 611A1 against the housings 600 are provided to the entry-side fixation member 603.

These cylinders allow application of desired force to the upper work roll 610 and the like in a direction orthogonal to the roll-axis direction.

As depicted in FIG. 20, FIG. 24, and FIG. 25, bearings 620A1 are provided at axial end sections of the upper intermediate roll 620 on both the drive side and the work side, and these bearings are supported by an upper intermediate roll bearing housing 622. Similarly, the lower intermediate roll 621 also has bearings 621A1 provided at its axial end sections on both the drive side and the work side, and these bearings are supported by a lower intermediate roll bearing housing 623.

Regarding the upper intermediate roll 620, on both the work side and the drive side, an upper intermediate roll bending cylinder 650 provided to the exit-side fixation member 602, and an upper intermediate roll bending cylinder 651 provided to the entry-side fixation member 603 support the upper intermediate roll bearing housing 622, and by driving these cylinders as appropriate, bending force is applied to the bearings vertically toward the increase side.

Regarding the lower intermediate roll 621 also, on both the work side and the drive side, a lower intermediate roll bending cylinder 652 provided to the exit-side fixation member 602, and a lower intermediate roll bending cylinder 653 provided to the entry-side fixation member 603 support the lower intermediate roll bearing housing 623, and by driving these cylinders as appropriate, bending force is applied to the bearings vertically toward the increase side.

These bending cylinders 640, 641, 644, and 645 apply the work roll balance force Pb to the work rolls 610 and 611.

In addition, as depicted in FIG. 20 and FIG. 24, an upper-intermediate-roll bearing-housing anti-backlash cylinder 672 is provided to the entry-side fixation member 603 such that the upper-intermediate-roll bearing-housing anti-backlash cylinder 672 applies horizontal force to the upper intermediate roll 620 via the upper intermediate roll bearing housing 622, and an upper-intermediate-roll bearing-housing anti-backlash cylinder 671 is provided to the exit-side fixation member 602 such that the upper-intermediate-roll bearing-housing anti-backlash cylinder 671 applies horizontal force to the upper intermediate roll 620 via the upper intermediate roll bearing housing 622.

Similarly, a lower-intermediate-roll bearing-housing anti-backlash cylinder 674 is provided to the entry-side fixation member 603 such that the lower-intermediate-roll bearing-housing anti-backlash cylinder 674 applies horizontal force to the lower intermediate roll 621 via the lower intermediate roll bearing housing 623, and a lower-intermediate-roll bearing-housing anti-backlash cylinder 673 is provided to the exit-side fixation member 602 such that the lower-intermediate-roll bearing-housing anti-backlash cylinder 673 applies horizontal force to the lower intermediate roll 621 via the lower intermediate roll bearing housing 623.

Here, in indirect driving in which the intermediate rolls 620 and 621 are driven, the largest load is applied in the entry side direction when overtorque is applied to the intermediate rolls 620 and 621. At that time, the load is received on the entry-side housing 600, and overload according to the torque amplification factor is prevented from being applied to the exit-side upper-intermediate-roll bearing-housing anti-backlash cylinder 671 and lower-intermediate-roll bearing-housing anti-backlash cylinder 673. Whereas the upper-intermediate-roll bearing-housing anti-backlash cylinder 672 and the lower-intermediate-roll bearing-housing anti-backlash cylinder 674 are not used in FIG. 20, it is also possible to use the upper-intermediate-roll bearing-housing anti-backlash cylinder 672 or the lower-intermediate-roll bearing-housing anti-backlash cylinder 674 instead of the upper-intermediate-roll bearing-housing anti-backlash cylinder 671 or the lower-intermediate-roll bearing-housing anti-backlash cylinder 673. Whereas a case where the torque amplification factor is 3 is mentioned with reference to FIG. 4, when the torque amplification factor is equal to or smaller than 2, the sum of horizontal force of (b) when Tr1 is applied becomes larger than the sum of horizontal force (c) when Tr2 is applied in some cases, and in such a case, it becomes possible to further reduce output power of intermediate-roll bearing-housing anti-backlash cylinders by using the upper-intermediate-roll bearing-housing anti-backlash cylinder 672 or the lower-intermediate-roll bearing-housing anti-backlash cylinder 674, and thus it is made possible to select using the upper-intermediate-roll bearing-housing anti-backlash cylinder 671 and the lower-intermediate-roll bearing-housing anti-backlash cylinder 673 or using the upper-intermediate-roll bearing-housing anti-backlash cylinder 672 and the lower-intermediate-roll bearing-housing anti-backlash cylinder 674 taking the magnitude of Tr1 or Tr2 into consideration.

In addition, the upper-work-roll bearing-housing anti-backlash cylinder 660 and the lower-work-roll bearing-housing anti-backlash cylinder 662 apply force to press the bearing housings 612 and 613 of the small-diameter work rolls 610 and 611, and support the small-diameter work rolls 610 and 611 to prevent them from moving in the rolling direction. FIG. 4 depicts the sums of horizontal force that is applied onto rolls (b) when Tr1 is applied and (c) when Tr2 is applied under a condition where an offset amount is set such that the sum of an offset component of the rolling load Pr and the inter-roll tangential force (the sum of horizontal force) becomes almost 0 when (d) normal rolling is performed. The sum of horizontal force applied onto the work rolls becomes 0 in any of the cases of (b), (c), and (d) in a case of intermediate roll driving, but it is difficult to make all the offset component and the inter-roll tangential force the same in actual operation and facilities, and also the torque amplification factor varies within a certain range depending on rolling conditions. Accordingly, the sum of horizontal force becomes a value which is not 0. In this manner, it is possible to prevent the small-diameter work rolls 610 and 611 from moving in the rolling direction even when the sum of horizontal force that is generated due to changes in the rolling conditions or the like is applied. Note that here the upper-work-roll bearing-housing anti-backlash cylinder 660 and the lower-work-roll bearing-housing anti-backlash cylinder 662 are installed on the entry side of the rolling direction, but they can be installed on the exit side. Furthermore, it is also possible to use the entry-side intermediate-roll bearing-housing anti-backlash cylinders 672 and 674 for the large-diameter work rolls 610A and 611A as large diameter work-roll bearing-housing anti-backlash cylinders along with the upper-work-roll bearing-housing anti-backlash cylinder 660 and the lower-work-roll bearing-housing anti-backlash cylinder 662.

In a case of the large-diameter work rolls 610A and 611A, the rolling torque Tr becomes larger than that at the time when the small-diameter work rolls 610 and 611 are used in some cases, and also the sum of horizontal force (b) when Tr1 is applied and (c) when Tr2 is applied in a case of work roll driving becomes large as compared to that in a case of intermediate roll driving as depicted in FIG. 4 in some cases. Accordingly, output power of anti-backlash cylinders which is larger than that of anti-backlash cylinders for a small diameter is required in some cases. In addition, the anti-backlash cylinders support the rolls preferably near the centers of the rolls in the upward/downward direction. In view of this, in preparation for a case where the work-roll bearing-housing anti-backlash cylinder 660 and the lower-work-roll bearing-housing anti-backlash cylinder 662 are not sufficient to fully support, the upper-intermediate-roll bearing-housing anti-backlash cylinder (upper large-diameter work-roll bearing-housing anti-backlash cylinder) 672 and the lower-intermediate-roll bearing-housing anti-backlash cylinder (lower large-diameter work-roll bearing-housing anti-backlash cylinder) 674 can also be used as anti-backlash cylinders for the large-diameter work rolls 610A and 611A. Furthermore, whereas a six-stage rolling mill in which large-diameter work rolls are attached is depicted in the rolling facility 1B depicted in FIG. 18, the intermediate-roll bearing-housing anti-backlash cylinders and the work-roll bearing-housing anti-backlash cylinders depicted in FIG. 20 can be used in that case also, and it is made possible to use both small-diameter work rolls and large-diameter work rolls in the facility.

Furthermore, bearings (not depicted in figures) are provided at axial end sections of the upper backup roll 630 on both the drive side and the work side, and these bearings are supported by an upper backup roll bearing housing 632. Similarly, bearings (not depicted in figures) are also provided at axial end sections of the lower backup roll 631 on both the drive side and the work side, and these bearings are supported by a lower backup roll bearing housing 633.

In addition, as depicted in FIG. 20, the exit-side housing 600 is provided with an upper-backup-roll bearing-housing anti-backlash cylinder 680 such that the upper-backup-roll bearing-housing anti-backlash cylinder 680 applies horizontal force to the upper backup roll 630 via the upper backup roll bearing housing 632. Similarly, the exit-side housing 600 is provided with a lower-backup-roll bearing-housing anti-backlash cylinder 682 such that the lower-backup-roll bearing-housing anti-backlash cylinder 682 applies horizontal force to the lower backup roll 631 via the lower backup roll bearing housing 633.

The hydraulic device 90 is connected to each hydraulic cylinder such as each bending cylinder or anti-backlash cylinder mentioned above, the shift cylinders 615 and 617, or rolling devices (not depicted in figures) that apply roll force for rolling the rolled material 5 to the upper work roll 610 and the lower work roll 611, and the hydraulic device 90 is connected to the controller 80.

In contrast to this, in the four-stage rolling mill depicted in FIG. 22, on the work side of axial end sections of the upper work roll 610A in the rolls, a bearing 610A2 (see FIG. 27) that shifts in the roll-axis direction along with the upper work roll 610A, and receives a load from the roll is provided, and the bearing 610A2 is supported by a work-side upper work roll bearing housing 612A. Similarly, on the drive side also, a bearing 610A2 (see FIG. 27) that shifts in the roll-axis direction along with the upper work roll 610A, and receives a load from the roll is provided, and the bearing 610A2 is supported by a drive-side upper work roll bearing housing 612A.

Similarly, the lower work roll 611A also has bearings 611A2 provided at its axial end sections on both the drive side and the work side, and these bearings are supported by the work-side and drive-side lower work roll bearing housings 613A, respectively.

In the present embodiment, the upper work roll 610A is configured to be able to shift in the roll-axis direction due to the shift cylinder 615 like the one depicted in FIG. 27 via the work side upper work roll bearing housing 612A. Similarly, the lower work roll 611A is also configured to be able to shift in the roll-axis direction due to the shift cylinder 616 like the one depicted in FIG. 27 via the work side lower work roll bearing housing 613A.

As depicted in FIG. 22 and FIG. 26, in the F6 stand 60A, on both the work side and the drive side, the upper intermediate roll bending cylinders 650, and the upper-intermediate-roll bending cylinders 651 support the upper work roll bearing housings 612A. Two upper-intermediate-roll bending cylinders 650 are provided in the roll-axis direction of the exit-side fixation member 602, and two upper intermediate roll bending cylinders 651 are provided in the roll-axis direction of the entry-side fixation member 603. By driving these cylinders as appropriate, bending force is applied vertically to the bearings 610A2 of the upper work roll 610A.

Similarly, on both the work side and the drive side, the lower intermediate roll bending cylinder 652 provided to the exit-side fixation member 602, and the lower intermediate roll bending cylinder 653 provided to the entry-side fixation member 603 support the lower work roll bearing housings 613A, and by driving these cylinders as appropriate, bending force is applied to the bearings of the lower work roll 611A vertically.

These bending cylinders 650, 651, 652, and 653 apply the roll balance force to the work rolls 610A and 611A.

Furthermore, as depicted in FIG. 22 and FIG. 26, for the purpose of preventing backlashes, the upper-work-roll bearing-housing anti-backlash cylinder 660 and the upper large-diameter work-roll bearing-housing anti-backlash cylinder 672 apply horizontal force, specifically pressing force in the rolling direction, to the upper work roll 610A via liners (not depicted in figures) of the upper work roll bearing housings 612A, and press the bearings 610A2 to the housings 600.

Similarly, the lower-work-roll bearing-housing anti-backlash cylinder 662 and the lower large-diameter work-roll bearing-housing anti-backlash cylinder 674 apply pressing force in the rolling direction to the lower work roll 611A via liners of the lower work roll bearing housings 613A, and press the bearings 611A2 to the housings 600.

In addition, in the rolling mill of the present embodiment, as depicted in FIG. 28 and FIG. 29, desirably, the same type of drive spindle is used for work roll driving of the large-diameter work rolls 610A and 611A, and driving the intermediate rolls 620 and 621 for driving the small-diameter work rolls 610 and 611.

As depicted in FIG. 28, the drive spindle is coupled with the intermediate rolls 620 and 621, and drives the intermediate rolls 620 and 621. Since it is also possible to make the diameter of the drive spindle larger than the diameter of the intermediate rolls 620 and 621 by driving the intermediate rolls 620 and 621 in this manner, the drive spindle with high strength can be used even if the diameter of the intermediate rolls 620 and 621 is small.

In particular, the roll speed is higher at a latter stage of a finishing rolling mill, and the rotational speed of rolls becomes higher. If it is possible to increase the diameter of the drive spindle, the natural frequency of deflection vibration of the drive spindle can be increased, and even if the rotational speed of rolls increases, the natural frequency of deflection vibration can be made higher than the rotational speed of the rolls, and resonance with the deflection vibration can be suppressed.

In addition, as depicted in FIG. 29, it is made possible also to couple the drive spindle with the large-diameter work rolls 610A and 611A, and to drive the work rolls 610A and 611A. In a case of the large-diameter work rolls 610A and 611A, the diameter of the drive spindle also can be increased, and the load capacity is high. When there is a concern over an inter-roll slide if the intermediate rolls 620 and 621 are driven, rolling with larger rolling torque Tr becomes possible by driving the work rolls 610A and 611A.

Here, when it is made possible to switch between a four-stage rolling mill including the large-diameter work rolls 610A and 611A and a six-stage rolling mill including the small-diameter work rolls 610 and 611 and the intermediate rolls 620 and 621, a diameter Di2 of the intermediate rolls 620 and 621 is desirably made larger than a diameter Dw2 of the work rolls 610 and 611.

Horizontal force applied onto the intermediate rolls 620 and 621 is larger than horizontal force applied onto the work rolls 610 and 611. This is for avoiding a situation where this horizontal force inevitably warps the rolls horizontally, an inter-roll offset amount that is set in the initial period increases due to the warping, the horizontal force increases further, the resultant force of the horizontal force and an offset component of the rolling load Pr is applied onto the rolls, and a problem in terms of strength occurs.

In addition, when the direction of horizontal force changes in a transitional period, and the rolls move in the rolling direction, this gives rise to a problem that local slides occur between the work rolls 610 and 611 and the intermediate rolls 620 and 621, and the rolls are damaged.

In view of this, desirably, the diameter Di2 of the intermediate rolls 620 and 621 is made larger than the diameter Dw2 of the work rolls 610 and 611, and warping of the intermediate rolls 620 and 621 is reduced.

The drive spindle depicted in FIG. 28 and FIG. 29 has universal joints 760. Whereas the angles of the universal joints 760 change in response to changes in the diameter of the work rolls themselves that are used in a case of typical work roll driving, the angles of the universal joints 760 are changed also when the same type of universal joints 760 is used for work roll driving of the large-diameter work rolls 610A and 611A, and for driving the intermediate rolls 620 and 621 to drive the small-diameter work rolls 610 and 611 as in the present embodiment.

The angles of the universal joints 760 are preferably equal to or smaller than 3 degree. If the distance between the universal joints 760 at two locations is defined as L1, the relation of $Di2\ max=2\ (2L1\ min \times \tan 3° + Dw1\ min/2 - Dw2\ max))$ holds true. Here, L1 min is the minimum value that L1 can be.

In a case where the diameter Di2 of the intermediate rolls 620 and 621 is set such that it does not exceed the largest diameter Di2 max that the intermediate rolls 620 and 621 can have, the angles of the universal joints 760 relative to the spindle that drives the large-diameter work rolls 610A and 611A, and the spindle that drives the intermediate rolls 620 and 621 when the small-diameter work rolls 610 and 611 can be made equal to or smaller than 3° without shifting the position of the drive spindle on the side opposite to the rolls, and a simple driving device 750 can be realized.

Note that in a case where the diameter Di2 of the intermediate rolls 620 and 621 is set such that it exceeds the largest diameter Di2 max that the intermediate rolls 620 and 621 can have, it becomes possible to make the angles of the universal joint 760 equal to or smaller than 3° by shifting the position of the drive spindle in the upward/downward direction on the side opposite to the rolls. In this case, the structure of the driving device 750 becomes complicated to some extent, but the same type of drive spindle can be used.

The universal joints 760 may be cross pin type universal joints, gear type universal joints or another type of universal joints, and their type is not limited.

The outer diameters of roll axial end sections are made smaller than at least bearing internal diameters such that bearing housings and bearings can be incorporated into rolls together.

When the diameter of the upper intermediate roll 620 and the lower intermediate roll 621 is smaller than the diameter of the upper work roll 610A and the lower work roll 611A, the internal diameter of roll axial end sections coupled with roll-side couplings of the universal joints 760 as in FIG. 28 and FIG. 29 is determined according to the outer diameter of roll axial end sections of the upper intermediate roll 620 and the lower intermediate roll 621. Even if the outer diameter of the roll axial end sections of the upper intermediate roll 620 and the lower intermediate roll 621 is made large as much as possible, the outer diameter of the roll axial end sections of the upper work roll 610A and the lower work roll 611A inevitably becomes small as compared to the bearing internal diameter of the upper and lower work rolls. Because of this, the rolling torque that can be transferred in a case of work roll driving is constrained by the roll axial end sections with low strength.

Figure 30:
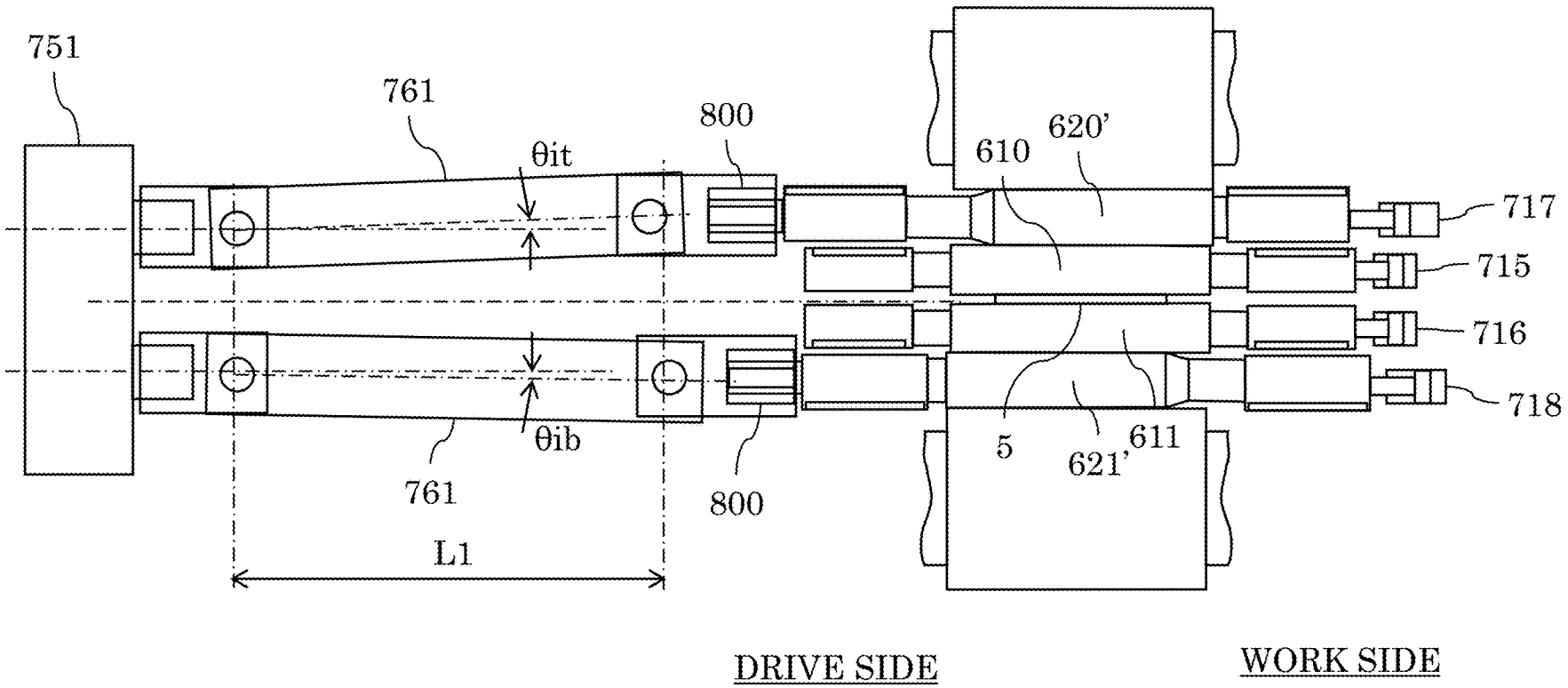
FIG. 30 is a figure depicting a state in the rolling mill according to the present invention where the same type of drive spindle is used.
Figure 31:
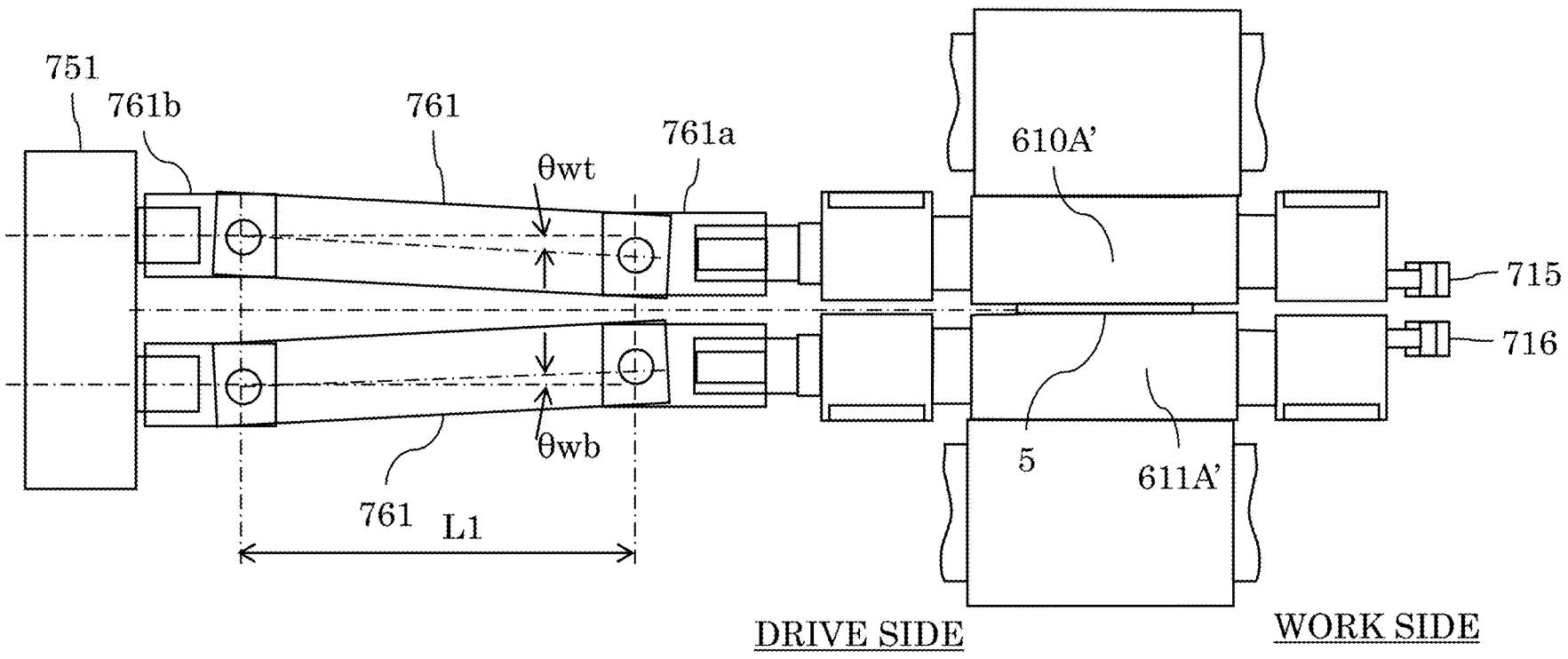
FIG. 31 is a figure depicting a state in the rolling mill according to the present invention where the same type of drive spindle is used.

In order to solve this, in FIG. 31, the outer diameter of roll axial end sections of an upper work roll 610A' and a lower work roll 611A' is made larger than that in FIG. 29 within a range smaller than the internal diameter of their bearings. Thereby, the diameters of universal joints 761, roll-side couplings 761*a*, and driving-device-side couplings 761*b* coupled with a driving device 751 can be increased, and the rolling torque that can be transferred can be increased. FIG. 30 depicts a case where the diameter of an upper intermediate roll 620' and a lower intermediate roll 621' is smaller than the diameter of the upper work roll 610A' and the lower work roll 611A' in FIG. 31. The outer diameter of roll axial end sections of the upper intermediate roll 620' and the lower intermediate roll 621' is smaller than the outer diameter of roll axial end sections of the upper work roll 610A' and the lower work roll 611A', but, in FIG. 30, the universal joints 761 in FIG. 31 can also be used by providing attachable and detachable gap filling members 800 at portions where axial end sections of the upper intermediate roll 620' and the lower intermediate roll 621' fit to the roll-side couplings 761*a*.

In a case of work roll driving, the outer diameter of the roll-side couplings 761*a* of the universal joints 761 cannot be made larger than the diameter of body sections of the work rolls in order to avoid interference in the upward/downward direction. On the other hand, in a case of intermediate roll driving, the outer diameter of the roll-side couplings 761*a* of the universal joints 761 can be made larger than the diameter of body sections of the intermediate rolls, and thus the diameter of the body sections of the intermediate rolls does not constrain the outer diameter of the roll-side couplings 761*a* of the universal joints 761.

The gap filling members 800 are attached at the roll axial end sections of the upper intermediate roll 620' and the lower intermediate roll 621' after bearing housings and bearings are incorporated into the rolls together. When the mode of rolling is switched from rolling depicted in FIG. 31 to rolling depicted in FIG. 30, the upper work roll 610A' and the lower work roll 611A' are taken out of the rolling mill, and then the upper intermediate roll 620' and the lower intermediate roll 621' on which the gap filling members 800 are attached, and the upper work roll 610 and the lower work roll 611 are inserted into the rolling mill. It can be made possible to switch between driving of the large-diameter upper work roll 610A' and lower work roll 611A', and the small-diameter upper intermediate roll 620', and lower intermediate roll 621' without changing the roll-side couplings 761*a*.

Here, it is also possible to attach the gap filling members 800 on the side of the roll-side couplings 761*a*, and this provides similar advantages. When it is relatively easy to attach the gap filling members 800 on the side of the roll-side couplings 761*a* in the rolling mill, this manner can be selected also.

When the mode of rolling is switched from the rolling depicted in FIG. 30 to the rolling depicted in FIG. 31, the upper intermediate roll 620' and the lower intermediate roll 621', and the upper work roll 610 and the lower work roll 611 are taken out of the rolling mill, and then, in a case where the gap filling members 800 are attached on the side of the roll-side couplings 761*a*, the gap filling members 800 are detached, and then the upper work roll 610A' and the lower work roll 611A' are inserted into the rolling mill.

The controller 80 is a device that controls operation of each piece of equipment in the rolling facilities 1, 1A, 1B, and 1C, and suitably includes a computer or the like including a CPU, a storage medium, a display device, or the like.

For example, the controller 80 controls actuation of the hydraulic device 90, and causes a hydraulic fluid to be supplied to each bending cylinder or the like mentioned above or to be discharged from each bending cylinder or the like mentioned above to thereby controls driving of each cylinder.

In addition, at the time of direct driving, the controller 80 performs driving control of the upper work roll 610A and the lower work roll 611A, and, at the time of indirect driving, the controller 80 performs driving control of the upper intermediate roll 620 and the lower intermediate roll 621 such that drive torque Tr of the upper intermediate roll 620 and the lower intermediate roll 621 is supplied to the upper work roll 610 and the lower work roll 611, and the upper work roll 610 and the lower work roll 611 are driven.

As depicted in FIG. 16, the controller 80 has a first acquiring section 80*a*, a first calculating section 80*b*, a second calculating section 80*c*, a traction coefficient calculating section 80*d*, a second acquiring section 80*e*, a step comparing section 80*f*, a setting section 80*g*, a storage section 80*h*, and the like.

The first acquiring section 80*a* is a portion that obtains the mill longitudinal rigidity coefficient K of the rolling mill, and suitably is a portion that acquires the latest value of mill longitudinal rigidity coefficients K of the relevant rolling mill that are recorded in advance on the storage section 80*h* or the like.

The first calculating section 80*b* is a portion that uses the acquired mill longitudinal rigidity coefficient K and rolling conditions to determine the kiss roll load Pk of the upper work roll 610 and the lower work roll 611 at the angle θx of the tip position of the rolled material 5 relative to the upper work roll 610 and the lower work roll 611 between the start of biting of the rolled material 5 and completion of the biting.

The second calculating section 80*c* is a portion that determines the rolling load Pr and the drive torque Tr in relation to the angle θx of the tip position of the rolled material 5 relative to the upper work roll 610 and the lower work roll 611 between the start of biting of the rolled material 5 and completion of the biting.

The traction coefficient calculating section 80*d* is a portion that determines the traction coefficient μrt between the upper work roll 610 and the upper intermediate roll 620, and between the lower work roll 611 and the lower intermediate roll 621 in relation to the angle θx of the tip position relative to the upper work roll 610 and the lower work roll 611 from the sum P of the kiss roll load Pk, the rolling load Pr, and hypothetical work roll balance force Pb, and the drive torque Tr between the start of biting of the rolled material 5 and completion of the biting in a state in which the hypothetical work roll balance force Pb is applied.

The second acquiring section 80*e* is a portion that obtains the tolerated value μrtcr of the traction coefficient μrt of the rolling mill.

Here, the tolerated value μrtcr is the tolerated maximum value of the traction coefficient μrt, and is such a value that when a traction coefficient equal to or larger than this value is necessary, a significant slide is caused between an intermediate roll and a work roll, and rolling becomes difficult.

The step comparing section 80*f* is a portion that compares the maximum value μrtmax of the traction coefficient μrt determined by the traction coefficient calculating section 80*d* with the tolerated value μrtcr of the traction coefficient μrt.

The setting section 80*g* is a portion that resets the work roll balance force at the start of biting of the rolled material 5 to a value which is equal to or larger than the required limit work roll balance force Pbcr1cr that is required when the traction coefficient μrt assumes the maximum value μrtmax, and is equal to or smaller than the limit work roll balance force Pbcr2 that is determined from a constraint in terms of the strength of the rolling mill when the tolerated value μrtcr of the traction coefficient μrt becomes equal to or larger than the maximum value μrtmax of the traction coefficient μrt.

The storage section 80*h* is a storage device of a computer included in the controller 80, and suitably includes an SSD or an HDD.

Control of operation of each piece of equipment, and control of operation of the first acquiring section 80*a*, the first calculating section 80*b*, the second calculating section 80*c*, the traction coefficient calculating section 80*d*, the second acquiring section 80*e*, the step comparing section 80*f*, the setting section 80*g*, and the like by the controller 80 are executed on the basis of various types of program recorded on the storage section 80*h*.

Note that operation control processes executed by the controller 80 may be integrated into one program, may be a plurality of separate programs, or may be a combination of these.

In addition, some or all of the programs may be realized by dedicated hardware or may be formed as modules.

Figure 32:
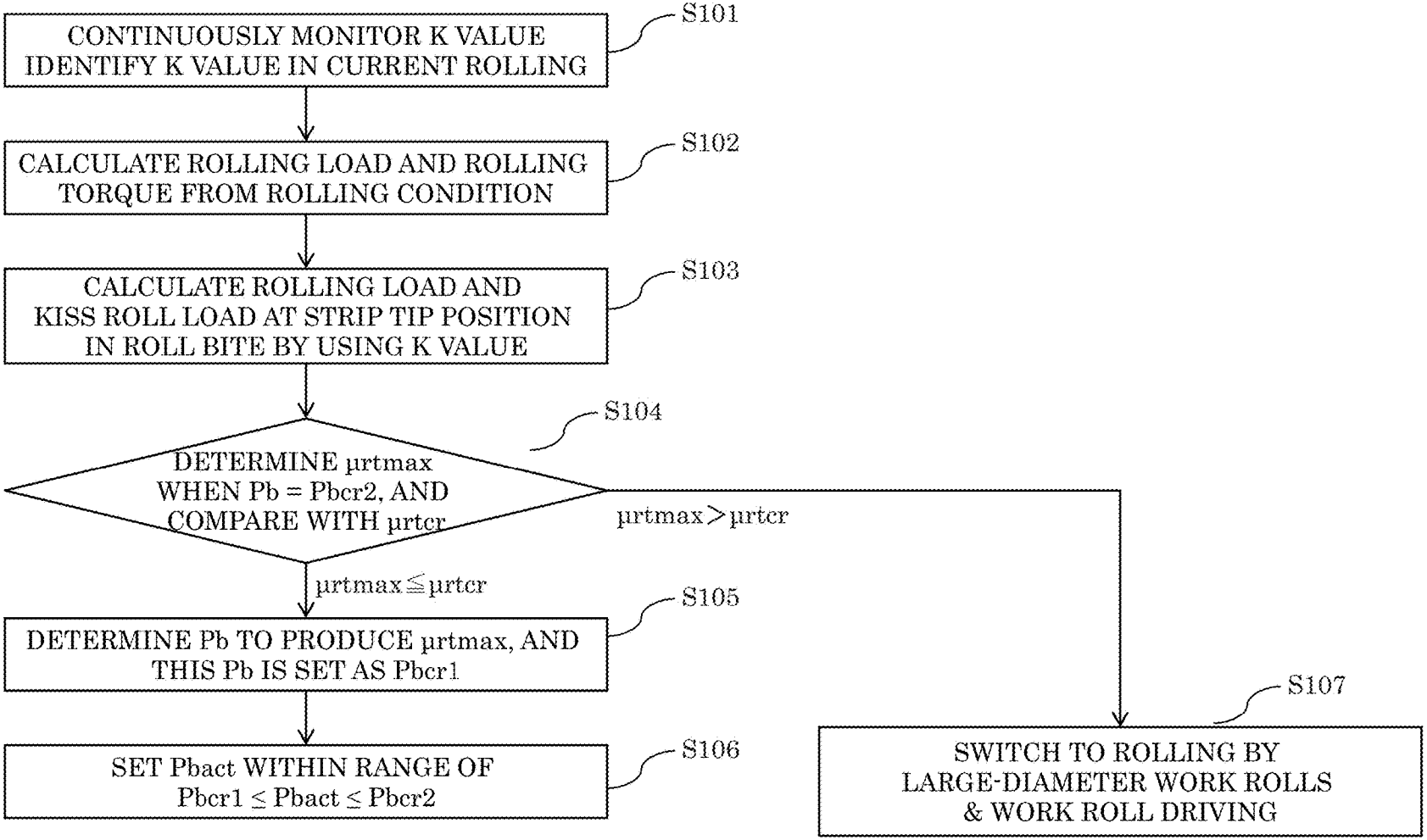
FIG. 32 is a flowchart depicting the flow of a determination of set work roll balance force Pbact according to the present invention.

Next, a work roll balance force setting method and a rolling mill running switching method of the rolling mill according to the present embodiment are explained with reference to FIG. 32. FIG. 32 is a flowchart depicting the flow of a determination of the set work roll balance force Pbact.

First, as depicted in FIG. 32, the mill longitudinal rigidity coefficient K is monitored continuously, and the mill longitudinal rigidity coefficient K of the current rolling is identified (Step S101). This Step S101 is equivalent to a step of obtaining the mill longitudinal rigidity coefficient K.

More specifically, the mill longitudinal rigidity coefficient K may be calculated for work roll balance force setting, or an existing numerical value (a value at the time of the delivery of the rolling mill, a value after several years of activation, etc.) that is recorded on the storage section 80*h* or the like may be read in as the mill longitudinal rigidity coefficient K. As the existing numerical value, any of values that a manufacturer who is actually activating the rolling mill has obtained by measurement and computation at each predetermined timing like at the time of the delivery of the rolling mill, one year after, two years after . . . , and so on for management of the rolling mill can be used as is.

Here, at the step of obtaining the mill longitudinal rigidity coefficient K, when the mill longitudinal rigidity coefficient K has been obtained twice or more about the rolling mill, the latest mill longitudinal rigidity coefficient K is desirably used.

Next, the rolling load Pr and the rolling torque Tr are calculated from rolling conditions (Step S102). This Step S102 is equivalent to a step of determining the rolling load Pr and the rolling torque Tr.

At this step, the moment of biting means a timing just before the start and at the start of biting, and completion of the biting is a timing at which the angle θx of the tip position becomes 0. Since there can be cases where the kiss roll load Pk changes before the start and just before the start, it is sufficient if there is at least data of the kiss roll load Pk from the moment when biting occurs, there is little necessity for use of the kiss roll load Pk "before the start" when a rolled material is apart from rolls, and thus the rolling load Pr and the rolling torque Tr are desirably determined from the start of biting.

Here, the rolling conditions are information such as an entry-side thickness, an exit-side thickness, the width of the rolled material, or the hardness of the rolled material in the relevant rolling mill, and the rolling torque is determined by using a known computation method.

Next, the rolling load Pr and a kiss roll load at the strip tip position in a roll bite are calculated by using the mill longitudinal rigidity coefficient K (Step S103). This Step S103 is equivalent to a step of determining the kiss roll load Pk.

Next, the maximum value μrtmax is determined supposing that the work roll balance force Pb is the upper limit work roll balance force Pbcr2, and the maximum value μrtmax is compared with the tolerated value μrtcr (Step S104). This step is equivalent to a step of determining the traction coefficient μrt and the maximum value μrtmax of the traction coefficient, a step of obtaining the tolerated value μrtcr of the traction coefficient μrt of the rolling mill, and a step of comparing the maximum value μrtmax with the tolerated value μrtcr.

Here, it is supposed that hypothetical work roll balance force is applied, for example the work roll balance force Pb is 0, 350, and 700 [kN/roll], and 0.15 is used as a constant when water is used as a coolant, 0.10 is used as a constant when an oil is used or another value is used as a constant because the tolerated value μrtcr of the traction coefficient is difficult to measure. In addition, at this Step S104, the traction coefficient μrt that is observed when the kiss roll load Pk becomes 0, that is, local maximums depicted in FIG. 10, FIG. 11 and FIG. 13, between the start of biting of the rolled material 5 and completion of the biting is used as the maximum value μrtmax of the traction coefficient μrt.

Next, when it is decided at Step S104 mentioned earlier that the maximum value μrtmax is equal to or smaller than the tolerated value μrtcr, the work roll balance force Pb that produces the maximum value μrtmax is determined. This work roll balance force Pb is set as the lower limit work roll balance force Pbcr1 (Step S105).

Here, the lower limit work roll balance force Pbcr1 is the lower limit value of the work roll balance force Pb for preventing a slide, and if the work roll balance force Pb is equal to or larger than the lower limit work roll balance force Pbcr1, the maximum value μrtmax does not exceed the tolerated value μrtcr, and thus rolling can be continued without occurrence of a significant slide between an intermediate roll and a work roll.

Thereafter, the set work roll balance force Pbact is set to a value within a range that satisfies the condition "lower limit work roll balance force Pbcr1≤set work roll balance force Pbact≤upper limit work roll balance force Pbcr2" (Step S106). This Step S106 is equivalent to a step of resetting the work roll balance force at the start of biting of the rolled material 5 to a value which is equal to or larger than the work roll balance force Pbcr1 that is required when the traction coefficient μrt assumes the maximum value μrtmax, and is equal to or smaller than the limit work roll balance force Pbcr2 that is determined from a constraint in terms of the strength of the rolling mill when the tolerated value μrtcr of the traction coefficient μrt becomes equal to or larger than the maximum value μrtmax of the traction coefficient μrt (i.e. an indirect driving mode is selected).

Here, the upper limit work roll balance force Pbcr2 is limit work roll balance force that is determined from a constraint in terms of the strength of the rolling mill, and is the maximum value of the work roll balance force Pb. The work roll balance force Pb beyond the maximum value can damage components, and thus cannot exceed the maxim value. Basically, the upper limit work roll balance force Pbcr2 is determined on the basis of the strength of work roll bearings and the strength of work roll necks.

The set work roll balance force Pbact is a value of the work roll balance force Pb that is actually set at the time of rolling, and is set to a certain setting value between the lower limit work roll balance force Pbcr1 and the upper limit work roll balance force Pbcr2, and other factors are also taken into consideration.

In contrast to this, when it is decided at Step S104 mentioned earlier that the maximum value μrtmax is larger than the tolerated value μrtcr, the large-diameter work rolls 610A and 611A are used, and the mode of rolling is switched to rolling by driving the work rolls 610A and 611A (Step S107).

In the rolling mill running method, running of the rolling mill is started after the work roll balance force is set after the work roll balance force is set according to each flow depicted in FIG. 32 mentioned above. Thereafter, the controller 80 presses the bearings 610A1 and 611A1 of the upper work roll 610 and the lower work roll 611 against the housings 600 of the rolling mill before the rolled material 5 is bitten by the upper work roll 610 and the lower work roll 611. Note that the timing at which pressing of the bearings 610A1 and 611A1 of the upper work roll 610 and the lower work roll 611 against the housings 600 of the rolling mill is desirably before mill idle running (before (a) in FIG. 2).

Next, advantages of the present embodiment are explained.

According to the work roll balance force setting method of the rolling mill according to the present embodiment mentioned above, the work roll balance force Pb is set taking also the kiss roll load Pk into consideration, and thus an inter-roll slide can be prevented without damaging components such as bearings even if kiss roll occurs at the time of biting.

Furthermore, in the rolling mill running switching method, a direct driving mode is selected when it is decided that the tolerated value μrtcr of the traction coefficient μrt is smaller than the maximum value μrtmax of the traction coefficient μrt, and an indirect driving mode is selected when it is decided that the tolerated value μrtcr of the traction coefficient μrt is equal to or larger than the maximum value μrtmax of the traction coefficient μrt. Thereby, the work roll balance force Pb is set taking also a kiss roll load into consideration, and thus an inter-roll slide can be prevented without damaging components such as bearings. In addition, when the traction coefficient is too large, a problem about torque transfer can be overcome by switching the driving mode not to indirect driving but to direct driving. Note that when large-diameter work rolls can be used for rolling regardless of whether μrtmax is larger than or smaller than μrtcr, it is possible to select the large-diameter-work-roll direct driving mode.

In addition, at the step of obtaining the mill longitudinal rigidity coefficient K, when the mill longitudinal rigidity coefficient K has been obtained twice or more about the rolling mill, the latest mill longitudinal rigidity coefficient K is used. There is a tendency that in the process of the use of the rolling mill, the mill longitudinal rigidity coefficient K becomes smaller, and thereby a kiss roll load increases. Accordingly, the latest value of the mill longitudinal rigidity coefficient K that has been influenced least by the mill longitudinal rigidity coefficient K due to temporal changes is used to thereby make it possible to more precisely determine a kiss roll load also, and precisely determine the work roll balance force also.

Furthermore, at the step of determining the traction coefficient μrt, the traction coefficient μrt that is observed when the kiss roll load Pk comes 0 between the start of biting of the rolled material 5 and completion of the biting is used as the maximum value μrtmax of the traction coefficient μrt. Since the traction coefficient μrt is F/P=F/(Pr+Pk+Pb), derivation of the maximum value μrtmax can be made simple by setting the traction coefficient μrt when Pk=0 as the maximum value μrtmax.

In addition, the rolling mill running method includes a step of starting running of the rolling mill after the work roll balance force is set after the work roll balance force is set, and a step of pressing the bearings 610A1 and 611A1 of the upper work roll 610 and the lower work roll 611 against the housings 600 of the rolling mill before the rolled material 5 is bitten by the upper work roll 610 and the lower work roll 611. If a kiss roll load is applied in a state in which the axial centers of the rolls are inclined relative to the original axial directions, for example, thrust force is generated between the upper work roll 610 and the upper intermediate roll 620, between the upper and lower work rolls 610 and 611, and so on, and there is a risk that bearings and the like are damaged in a case of small-diameter work rolls. However, by pressing the bearings 610A1 and 611A1 of the work rolls 610 and 611 against the housings 600, and preventing inclination of the axial centers in this manner, it is possible to make generation of thrust force unlikely, and it is possible to make damages of the bearings and the like unlikely even if a kiss roll load is generated between the work rolls 610 and 611.

Note that the present invention is not limited to the embodiment described above, but various modifications and applications are possible. The embodiment mentioned above is explained in detail for explaining the present invention in an easy-to-understand manner, and embodiments of the present invention are not necessarily limited to those including all the configurations explained.

REFERENCE SIGNS LIST

1, 1A, 1B, 1C: Rolling facility
5: Rolled material
10: F1 stand (rolling mill)
20: F2 stand (rolling mill)
30: F3 stand (rolling mill)
40: F4 stand (rolling mill)
50, 50C: F5 stand (rolling mill)
60, 60A, 60B, 60C: F6 stand (rolling mill)
80: Controller
80*a*: First acquiring section
80*b*: First calculating section
80*c*: Second calculating section
80*d*: Traction coefficient calculating section
80*e*: Second acquiring section
80*f*: Step comparing section
80*g*: Setting section
80*h*: Storage section
90: Hydraulic device
600: Housing
602: Exit-side fixation member
603: Entry-side fixation member
610: Upper work roll (first work roll)
610A, 610A': Upper work roll (second work roll)
610A1, 610A2, 611A1, 611A2, 620A1, 621A1: Bearing
611: Lower work roll (first work roll)
611A, 611A': Lower work roll (second work roll)
612, 612A: Upper work roll bearing housing
613, 613A: Lower work roll bearing housing
615, 616, 617, 618: Shift cylinder
620, 620': Upper intermediate roll
621, 621': Lower intermediate roll
622: Upper intermediate roll bearing housing
623: Lower intermediate roll bearing housing
630: Upper backup roll
631: Lower backup roll
632: Upper backup roll bearing housing
633: Lower backup roll bearing housing
640, 641: Upper work roll bending cylinder
644, 645: Lower work roll bending cylinder
650, 651: Upper intermediate roll bending cylinder
652, 653: Lower intermediate roll bending cylinder
660: Upper-work-roll bearing-housing anti-backlash cylinder (pressing device)
662: Lower-work-roll bearing-housing anti-backlash cylinder (pressing device)
671: Upper-intermediate-roll bearing-housing anti-backlash cylinder (pressing device)
672: Upper-intermediate-roll bearing-housing anti-backlash cylinder (upper large-diameter work-roll bearing-housing anti-backlash cylinder, pressing device)
673: Lower-intermediate-roll bearing-housing anti-backlash cylinder (pressing device)
674: Lower-intermediate-roll bearing-housing anti-backlash cylinder (lower large-diameter work-roll bearing-housing anti-backlash cylinder, pressing device)
680: Upper-backup-roll bearing-housing anti-backlash cylinder
682: Lower-backup-roll bearing-housing anti-backlash cylinder
750, 751: Driving device
760, 761: Universal joint
761*a*: Roll-side coupling
761*b*: Driving-device-side coupling
800: Gap filling member

The invention claimed is:

1. A work roll balance force setting method of a rolling mill that includes a pair of upper and lower work rolls, and one or more pairs of upper and lower rolls that are provided on sides of the work rolls that are opposite to a rolled material, the rolling mill driving the work rolls by supplying a rolling torque from the rolls to the work rolls, the work roll balance force setting method comprising:

obtaining a mill longitudinal rigidity coefficient K of the rolling mill;

determining a kiss roll load Pk of the work rolls in relation to a work roll angle θx of a tip position of the rolled material between a start of biting of the rolled material and completion of the biting, the kiss roll load Pk being determined by using the obtained mill longitudinal rigidity coefficient K and a rolling condition;

determining a rolling load Pr and the rolling torque Tr in relation to the work roll angle θx of the tip position of the rolled material between a start of biting of the rolled material and completion of the biting;

determining a traction coefficient μrt between the work rolls and the rolls, and a maximum value μrtmax of the traction coefficient in relation to the work roll angle θx of the tip position in a state in which a hypothetical work roll balance force Pb is applied, the traction coefficient μrt between the work rolls and the rolls and the maximum value μrtmax of the traction coefficient being determined from a sum P of the kiss roll load Pk, the rolling load Pr, and the hypothetical work roll balance force Pb, and the rolling torque Tr between a start of biting of the rolled material and completion of the biting;

obtaining a tolerated value μrtcr of the traction coefficient μrt of the rolling mill;

comparing the maximum value μrtmax determined at the step of determining the traction coefficient μrt with the tolerated value μrtcr; and resetting a work roll balance force at a start of biting of the rolled material to a value which is equal to or larger than the work roll balance force that is required when the traction coefficient μrt assumes the maximum value μrtmax, and equal to or smaller than the work roll balance force that is a limit based on a constraint in terms of strength of the rolling mill, when the tolerated value μrtcr is equal to or larger than the maximum value μrtmax.

2. The work roll balance force setting method according to claim 1, wherein at the step of obtaining the mill longitudinal rigidity coefficient K, a latest mill longitudinal rigidity coefficient value is used when the mill longitudinal rigidity coefficient K is obtained about the rolling mill twice or more.

3. The work roll balance force setting method according to claim 1, wherein at the step of determining the traction coefficient μrt, the traction coefficient μrt that is observed when the kiss roll load Pk becomes 0 between a start of biting of the rolled material and completion of the biting is used as the maximum value μrtmax.

4. A rolling mill running method comprising the steps of:

setting the work roll balance force by using the work roll balance force setting method according to claim 1;

starting running of the rolling mill after the work roll balance force is set; and pressing bearings of each of the work rolls against a housing of the rolling mill before the rolled material is bitten by the work rolls.

5. A rolling mill running switching method comprising the steps of:

setting the work roll balance force by using the work roll balance force setting method according to claim 1;

deciding whether or not the tolerated value μrtcr is equal to or larger than the maximum value μrtmax;

selecting a direct driving mode of driving a pair of second upper and lower work rolls themselves with a diameter larger than a diameter of the work rolls when the tolerated value μrtcr is decided as being smaller than the maximum value μrtmax; and selecting an indirect driving mode of driving the work rolls by supplying the rolling torque Tr from the rolls to the work rolls when the tolerated value μrtcr is decided as being equal to or larger than the maximum value μrtmax.

6. A rolling mill comprising:

a pair of upper and lower work rolls; one or more pairs of upper and lower rolls that are provided on sides of the work rolls that are opposite to a rolled material; and a controller that performs driving control of the rolls such that the work rolls are driven by supplying rolling torque Tr from the rolls to the work rolls, wherein the controller has:

a first acquiring section that obtains a mill longitudinal rigidity coefficient K of the rolling mill;

a first calculating section that determines a kiss roll load Pk of the work rolls in relation to a work roll angle θx of a tip position of the rolled material between a start of biting of the rolled material and completion of the biting, the first calculating section determining the kiss roll load Pk by using the acquired mill longitudinal rigidity coefficient K and a rolling condition;

a second calculating section that determines a rolling load Pr and the rolling torque Tr in relation to the work roll angle θx of the tip position of the rolled material between a start of biting of the rolled material and completion of the biting;

a traction coefficient calculating section that determines a traction coefficient μrt between the work rolls and the rolls, and a maximum value μrtmax of the traction coefficient in relation to the work roll angle θx of the tip position in a state in which a hypothetical work roll balance force Pb is applied, the traction coefficient calculating section determining the traction coefficient μrt between the work rolls and the rolls, and the maximum value μrtmax of the traction coefficient from a sum P of the kiss roll load Pk, the rolling load Pr and the hypothetical work roll balance force Pb, and the rolling torque Tr between a start of biting of the rolled material and completion of the biting;

a second acquiring section that obtains a tolerated value μrtcr of the traction coefficient μrt of the rolling mill;

a step comparing section that compares the maximum value μrtmax determined by the traction coefficient calculating section with the tolerated value μrtcr; and a setting section that resets a work roll balance force at a start of biting of the rolled material to a value which is equal to or larger than the work roll balance force that is required when the traction coefficient μrt assumes the maximum value μrtmax, and equal to or smaller than the work roll balance force that is a limit based on a constraint in terms of strength of the rolling mill, when the tolerated value μrtcr is equal to or larger than the maximum value μrtmax.

7. The rolling mill according to claim 6, further comprising:

bearings that support each of the work rolls;

a housing that has therein the work rolls and the bearings; and a pressing device that presses the bearings against the housing;

wherein the controller is that controls the pressing device to press the bearings against the housing before the rolled material is bitten by the work rolls.

8. The rolling mill according to claim 6, wherein the controller further includes:

a deciding section that decides whether or not the tolerated value μrtcr is equal to or larger than the maximum value μrtmax; and a selecting section that:

selects a direct driving mode of driving a pair of second upper and lower work rolls themselves with a diameter larger than a diameter of the work rolls when the tolerated value μrtcr is decided as being smaller than the maximum value μrtmax; and selects an indirect driving mode of driving the work rolls by supplying the rolling torque Tr from the rolls to the work rolls when the tolerated value μrtcr is decided as being equal to or larger than the maximum value μrtmax.

9. The rolling mill according to claim 8, further comprising:

roll-side couplings of universal joints coupled with axial end sections of the rolls or the second work rolls; and axial end sections of the rolls whose outer diameter is smaller than axial end sections of the second work rolls;

wherein the rolling mill includes gap filling members that attach to and detach from portions where the roll-side couplings and the axial end sections of the rolls are fit.

* * * * *